US008479656B2

(12) United States Patent
Ciesiun et al.

(10) Patent No.: US 8,479,656 B2
(45) **Date of Patent: *Jul. 9, 2013**

(54) WATER BASED PAINTBALL AND METHOD FOR FABRICATING WATER BASED PAINTBALLS

(75) Inventors: Paul M. Ciesiun, Joliet, IL (US); Ronnie E. Bayless, Plant City, FL (US)

(73) Assignee: Hydro-Caps, LLC, Hodgkins, IL (US)

( * ) Notice: Subject to any disclaimer, the term of this patent is extended or adjusted under 35 U.S.C. 154(b) by 629 days.

This patent is subject to a terminal disclaimer.

(21) Appl. No.: 12/582,639

(22) Filed: Oct. 20, 2009

(65) Prior Publication Data

US 2010/0083862 A1 Apr. 8, 2010

Related U.S. Application Data

(63) Continuation-in-part of application No. 11/974,623, filed on Oct. 15, 2007, now Pat. No. 7,905,181, which is a continuation-in-part of application No. 11/051,647, filed on Feb. 5, 2005, now abandoned.

(51) Int. Cl.
*F42B 12/40* (2006.01)

(52) U.S. Cl.
USPC ..... 102/513; 102/502; 362/34

(58) Field of Classification Search
USPC ..... 102/513, 498, 502, 501; 362/34; 206/219
See application file for complete search history.

(56) References Cited

U.S. PATENT DOCUMENTS

| | | | |
|---|---|---|---|
| 2,318,718 | A | 12/1939 | Scherer |
| 3,774,022 | A | 11/1973 | Dubrow |
| 3,940,605 | A | 2/1976 | Gerber |
| 5,001,880 | A | 3/1991 | Smith |
| 5,018,450 | A | 5/1991 | Smith |
| 5,254,379 | A | 10/1993 | Kotsiopoulos et al. |
| 5,448,951 | A | 9/1995 | Olson |
| 5,762,058 | A | 6/1998 | Cheng |
| 6,210,709 | B1 | 4/2001 | Laba et al. |
| 6,298,841 | B1 | 10/2001 | Cheng |
| 6,375,981 | B1 | 4/2002 | Gilleland et al. |
| 6,615,739 | B2 | 9/2003 | Gibson |
| 6,949,256 | B2 | 9/2005 | Fonkwe et al. |
| 7,017,497 | B1 | 3/2006 | Gardner, Jr. |
| 2002/0112640 | A1 | 8/2002 | Brown |
| 2002/0134055 | A1 | 9/2002 | Martinez, Jr. |
| 2002/0134274 | A1 | 9/2002 | Martinez, Jr. |
| 2004/0234761 | A1 | 11/2004 | Hausmanns et al. |
| 2005/0106233 | A1 | 5/2005 | Andersen et al. |
| 2005/0266114 | A1 | 12/2005 | Meidenbauer |
| 2006/0005732 | A1 | 1/2006 | Forster |
| 2006/0011089 | A1 | 1/2006 | Hensel |
| 2006/0016361 | A1 | 1/2006 | Bland |
| 2006/0205546 | A1 | 9/2006 | Liu et al. |

(Continued)

FOREIGN PATENT DOCUMENTS

| | | | |
|---|---|---|---|
| JP | 11304676 | A | 11/1999 |

*Primary Examiner* — Benjamin P Lee

(74) *Attorney, Agent, or Firm* — Steven McMahon Zeller; Dykema Gossett PLLC

(57) ABSTRACT

A paintball includes first and second half shell portions, each with a recess that can hold liquid containing dyes or other marking pigments. The liquid in the second half shell portion is relatively viscous, or becomes so after being placed in the second shell portion. The second shell portion can then be inverted and the liquid will stay within it. Neither shell portion includes a barrier to hold the liquids in place. The second half shell portion can then be placed on and joined with the first half shell portion to form a paintball.

69 Claims, 16 Drawing Sheets

U.S. PATENT DOCUMENTS

2006/0288898 A1 12/2006 Byun
2007/0054762 A1 3/2007 Tocco
2007/0079722 A1 4/2007 Parish
2007/0148380 A1 6/2007 Black
2008/0134927 A1 6/2008 Skellern
2008/0163779 A1 7/2008 Campo
2008/0217812 A1 9/2008 Perrone

WATER BASED PAINTBALL AND METHOD FOR FABRICATING WATER BASED PAINTBALLS

This is a Continuation-In-Part Application of application Ser. No. 11/974,623 filed on Oct. 15, 2007, which is a continuation-In-Part Application of Parent application Ser. No. 11/051,647 filed on Feb. 5, 2005, now abandoned.

BACKGROUND OF THE INVENTION

1. Field of the Invention

This invention relates to a luminescent projectile used during night time paintball play or night time training exercises by military or police forces by which "tracer" and "marking" projectiles are utilized in low light or dark conditions. The "tracer" effect serves as entertainment or a visual reference for a line of fire, which allows for corrections and adjustments to be made. Further, in daytime paintball games or in military and police exercises, the visible "marking" of a target by the contents of a projectile generally designates elimination from play or participation.

This invention also relates to a paintball fabricated from an aqueous or water based material, rather than a hydrocarbon or glycerin and/or glycol based material. The tracer effect may be included with a water based paintball by adding a phosphorescent material to the aqueous material and/or to material that forms a shell portion of the paintball.

Further, this invention relates to a water based capsule for products regulated by the U.S. Food and Drug Administration.

In addition, the present invention also relates to a paintball having water based fill material therein and, more particularly, to a method for fabricating a plurality of paintballs with the water based fill material.

2. Background of the Prior Art

The use of Luminescent paintballs is known in the prior art. The prior art includes U.S. Pat. No. 5,018,450; U.S. Pat. No. 3,774,022; U.S. Pat. No. 3,940,605; U.S. Pat. No. 4,706,568; U.S. Pat. No. 5,762,058; U.S. Pat. No. Des. 264,364; and U.S. Pat. No. 6,298,841.

The problem with prior art luminescent paintballs is that the effective brilliance and duration of visible light emitted from the phosphorescent material in the paintball, is a function of the intensity and duration of exposure of the phosphorescent material to ultraviolet (UV) light. More specifically, the phosphorescent material in a liquefied material in an inner portion of the paintball, receives less UV light than an outer shell portion resulting in reduced visible light being emitted from the phosphorescent material of the inner portion of the luminescent paintball; but because there is a larger quantity of phosphorescent material in the inner portion than in the outer shell, the magnitude of emitted visible light from the inner portion is comparable to the magnitude of emitted visible light from the outer shell.

After the luminescent paintball is discharged from a paintball "gun," the emitted visible light (and the tracing effect) from the projected paintball begins to decay. Prior art luminescent paintballs having phosphorescent material in both the outer and inner portions provide an adequate tracing effect after being discharged from a paintball "gun." Prior art luminescent paintball having phosphorescent material in only the inner portion or only in the outer portion, provide an inadequate tracing effect after being discharged from a paintball gun.

Further, only the phosphorescent material of the inner portion marks or identifies a target struck during a nighttime luminescent paintball episode, because the outer shell ruptures and falls to the ground upon impacting the target. Should the phosphorescent material of the inner portion receive insufficient UV exposure or should the required marking time of the target be beyond the luminescent capabilities of the phosphorescent material, the luminescent paintball will correspondingly fail to identify a struck target thereby failing to promote the nighttime paintball episode.

A need exists for a glow in the dark paintball that provides a tracing effect when discharged from a paintball gun, and that provides a lasting marking feature when the paintball strikes a target. The tracing effect is provided by a phosphorescent material in only an outer shell of the paintball being exposed to UV light. The marking effect is provided by a light generating material in the inner portion of the paintball that does not require a UV light source, instead, the light generating material emits light due to a chemical reaction rather than by exposure to a UV light.

The use of hydrocarbons or oils such as glycol and glycerin for fabricating paintballs used during daylight or nighttime (by adding a phosphorescent material) hours is well known in the art. The problem with oil based paintballs using glycol and/or glycerin is that the paintball is relatively expensive to manufacture, especially with current oil prices constantly increasing. Further, oil based paintballs are not biodegradable, are difficult to wash from target surfaces, and remain on non-targeted surfaces such as trees and buildings for relatively long time periods.

A need exists for day and night paintballs that are relatively inexpensive, biodegradable and that use a paint that is relatively easy to remove from target and non-target surfaces.

Further, a need exists for applying the technology for fabricating the shells of paintballs to capsules of pharmaceutical "pills." More specifically, pharmaceutical capsules include polyethylene glycol as a "fill" material. Utilizing a water based fill material in the capsule, reduces the cost of fabrication and provides an aqueous filler to deliver medication via a capsule, which is ingested and provides a new method for the administration of drugs.

In addition, conventional methods of manufacturing softgel capsules or paintball shells use a rotary die process to simultaneously form gelatin shells into the desired shape and to fill the shells with non-aqueous liquid components. Since gelatin is a water soluble, animal-derived polymer, water based fillers cannot be encapsulated within gelatin shells. As a consequence, gelatin shell fills generally contain polyethylene glycols ("PEG") or oils which are compatible with gelatin but are expensive and limit the types of actives and additives which can be dissolved in the PEG.

Further, the rotary die process was designed specifically for water soluble gelatin shells, therefore thermoplastic and/or water insoluble polymers are not applicable to the rotary die process when fabricating shells. In the case of paintballs, there has long been a desire, for a water-based paintball fill that would not stain clothing or field structures, would not damage painted surfaces, would be easier to clean up, cost less to produce, and that would be more environmentally friendly. Leftover gelatin shells in many paintball fields can be problematic due to the bad smell as they decompose and the high biological oxygen demand ("B.O.D"), which can result from water runoff contaminated by gelatin. Manufacturers of paintballs have long sought a water based formula for the fill material in paintballs, and a method for fabricating paintballs with a water based fill material, since present formulas are expensive and in short supply. In addition, gelatin paintballs are often exposed to conditions which directly cause defects to occur within the inner fill or outer shell of the projectile. When prior art gelatin paintballs are subjected to temperatures above 85 F or high humidity, gelatin paintballs become soft and swell thus preventing proper shooting or breaking properties. When subjected to temperatures below 45 F, gelatin paintballs become brittle which can result in fracturing of the outer shell by the projection system, prior to engaging and impacting upon a target.

The paintball and the methods for fabricating the paintball of the present invention deviate substantially from that of prior art paintballs. While the prior art describes a multitude of fabrication methods, all fail to employ or remotely describe the combination of processes and materials found within the present invention. More particularly, the prior art fails to teach methods for assembling a non-water soluble, flangeless paintball that is commercially viable, capable of mass production, and yet employs a process that permits product variation and flexibility. This is evident by the absence of such a product and process in the paintball industry, which primarily employs soft gelatin manufacturing methods to produce paintballs. The present invention provides viable mass production methods, materials and parameters for those processes, and yields a distinct, commercially viable product when compared to the prior art.

SUMMARY OF THE INVENTION

It is an object of the present invention to overcome many of the disadvantages associated with luminescent paintballs. Further, it is an object of the present invention to incorporate many of the features of the prior art luminescent paintball which include but are not limited to paintball configuration, fabrication materials, paints and filler materials (glycols and glycerins).

A principal object of the present invention is to provide a bioluminescent paintball that can be utilized for allowing paintball games to be played in daylight, low light or dark conditions utilizing nighttime glow and a variance of colors that would allow for vast market distribution. A feature of the bioluminescent paintball is a phosphorescent material disposed in an outer shell. Another feature is a calcium neutralizing agent and a photoprotein disbursed within a liquefied substance disposed in an inner cavity of the bioluminescent paintball, the photoprotein providing visual light when combined with calcium, the neutralizing agent preventing the production of light should calcium be present in the paintball. An advantage of the bioluminescent paintball is that the paintball provides a tracing effect upon being projected from a paintball gun, and provides a visual light marking effect and paint mark upon a target after the bioluminescent paintball impacts the target and ruptures the outer shell to allow the liquefied substance to engage calcium on the target to produce visible light.

Another object of the present invention is to provide an alternative bioluminescent paintball that can be utilized in daylight, low light or dark conditions. A feature of the alternative bioluminescent paintball is a phosphorescent material disposed in an outer shell. Another feature is a first liquefied substance and an inner shell disposed within the outer shell, the first liquefied substance includes a protein disbursed therein. Yet another feature is a second liquefied substance disposed within the inner shell, the second liquefied substance includes an enzyme disbursed therein. An advantage of the alternative bioluminescent paintball is that the paintball provides a tracing effect when rejected from a paintball discharge device. Another advantage of the alternative bioluminescent paintball is that the paintball provides a visual light marking effect and paint mark upon a target after the paintball impacts the target, thereby rupturing the outer and inner shells and allowing the first and second liquefied substances in the shells to flow together to produce light to mark the target. This alternative bioluminescent paintball provides light without requiring the presence of calcium on the target, but the alternative paintball is more expensive to manufacture than the calcium reactive paintball.

Still another object of the present invention is to provide another alternative bioluminescent paintball that provides visible light without the presence of calcium on the target. A feature of the alternative paintball is a phosphorescent material disposed in an outer shell. Another feature of the alternative paintball is an inner wall inside the outer shell, the inner wall forming a first inner cavity containing a first liquid substance with an enzyme disbursed therein, and a second inner cavity containing a second liquid substance with a protein disbursed therein. An advantage of this alternative paintball is that the paintball provides a tracing effect when projected from a paintball discharge device. Another advantage of this alternative paintball is that the internal configuration promotes stability during flight and reduces the "bursting force" required to combine the enzyme and protein.

This alternative paintball requires the rupturing of only an inner wall upon target impact to provide visible light. The above alternative bioluminescent paintball requires the rupturing of an outer shell and an inner shell. The utilization of thixotropic thickeners to create an aqueous gel, allows the inner capsule to be stabilized and centrally located, thereby promoting an accurate flight projection of this alternate paintball.

Yet another object of the present invention is to provide paintballs (for day or night use) that are fabricated from water based or aqueous material instead of an oil based material. A feature of the water based paintballs is a soluble polymer shell. Another feature of the water based paintballs is an insoluble coating on an inner wall of the shell. An advantage of the water based paintballs is that the shell biodegrades relatively fast. Another advantage of the water based paintballs is that the shell will not degrade or dissolve when a water based or aqueous material is disposed within a cavity defined by the shell, due to the aqueous material engaging only the insoluble coating. Another object of the present invention is to provide water based paintballs that do not harm landscape exposed to paintball activity. A feature of the water based paintballs is neutralizing agent added to the aqueous material. An advantage of the water based paintballs is that the ph level of the aqueous material is substantially equal to the ph level of water (i.e. 7.0). Another advantage of the water based paintballs is that the aqueous material biodegrades relatively fast.

Another object of the present invention is to provide water based paintballs that are relatively easy and inexpensive to fabricate. A feature of the water based paintballs is an aqueous material that is substantially a gel when inactive and substantially a liquid when active. An advantage of the water based paintballs is that when the aqueous material is an inactive gel state, the aqueous material is relatively easy to encase in the insoluble coating and soluble shell. Another advantage of the water based paintball is that when the paintball is forcibly urged toward a target, the aqueous material is in an active liquid state that promotes the dispersing of the aqueous material (and pigments suspended in the aqueous material) upon a target surface to indicate a "hit" by a paintball participant.

Another object of the present invention is to provide a water based capsule for products regulated by the U.S. Food and Drug Administration. A feature of the water based capsule is a capsule fill material combined with a medication. An advantage of the water based capsule is that cost is reduced and the capsule fill (water) is readily absorbed by the body.

Briefly, the invention provides a bioluminescent paintball comprising a shell defining an interior cavity; a liquefied substance disposed within said cavity; a phosphorescent material disposed within said shell, said phosphorescent material providing a tracer effect when said bioluminescent paintball is ejected from a paintball discharge device; a neutralizing agent disbursed within said liquefied substance; and a photoprotein disbursed within said liquefied substance, said photoprotein producing visible light when combined with an ion such as calcium on a target after said bioluminescent paintball impacts the target thereby rupturing said shell and allowing said liquefied substance to engage the target.

The invention further provides a bioluminescent paintball comprising an outer shell defining a first interior cavity; a first liquefied substance disposed within said first interior cavity; an inner shell disposed within said first interior cavity, said inner shell defining a second interior cavity; a second liquefied substance disposed within said second interior cavity; a phosphorescent material disposed within said outer shell, said phosphorescent material providing a tracer effect when said bioluminescent paintball is ejected from a paintball discharge device; a protein disbursed within said first liquefied substance in said first interior cavity; an enzyme disbursed within said second liquefied substance in said second interior cavity, said enzyme and protein producing visible light when combined after said bioluminescent paintball impacts a target thereby rupturing said outer and inner shells and allowing said first and second liquefied substances in said first and second interior cavities to flow together to produce light to mark the target.

The invention further provides a bioluminescent paintball comprising an outer shell defining first and second inner cavities separated by an inner wall; a first liquid substance disposed within said first inner cavity; a second liquid substance disposed within said second inner cavity; a phosphorescent material disposed within said outer shell, said phosphorescent material providing a tracer effect when said bioluminescent paintball is ejected from a paintball discharge device; an enzyme disbursed within said first liquid substance in said first interior cavity; a protein disbursed within said second liquid substance in said second interior cavity, said enzyme and protein producing visible light when combined after said bioluminescent paintball impacts a target thereby rupturing said outer shell and said inner wall and allowing said first and second liquid substances in said first and second inner cavities to flow together to produce light to mark the target.

The invention further provides a paintball comprising a soluble shell defining an interior cavity; an insoluble coating disposed upon an inner surface of said shell; and an aqueous material disposed within said cavity, said aqueous material engaging said insoluble coating disposed upon said inner surface of said shell, whereby said aqueous material is prevented from dissolving said shell thereby promoting the marking of a target via said aqueous material when said paintball forcibly engages the target and ruptures said shell.

The invention further provides a method for fabricating paintballs, said method comprising the steps of fabricating a plurality of relatively rigid half-shells with central recesses; disposing an aqueous material in said recesses of said half-shells; allowing said aqueous material to gel; joining two of said half-shells with said gelled aqueous material disposed in said central recesses; and sealing said joined half-shells, whereby a paintball is fabricated that ultimately engages a target, whereupon, said half-shells rupture thereby promoting the engagement of a now substantially liquid aqueous material upon the target.

The invention further provides a method for fabricating paintballs, said method comprising the steps of fabricating a plurality of relatively rigid gel spheres of aqueous fill material; coating, dipping or spraying said aqueous material spheres with an insoluble material; and forming a shell about said coated aqueous spheres, whereby a spherical paintball is fabricated that ultimately engages a target, whereupon, said shell ruptures thereby promoting the engagement of a now substantially liquid aqueous material upon the target.

Soluble outer shell materials, such as gelatin, may be used if an insoluble coating is applied to the inner surface of the outer shell wall. This coating shall act as a barrier between the aqueous fill and outer soluble shell.

Further, this invention relates to methods and materials for manufacturing paintballs containing an aqueous-based fill for marking targets at night or during the day.

Liquefied Substance

The references to "liquefied substance" when detailing the present invention, unless otherwise stated, is an aqueous shear thinning gel containing a rheology modifier, and other additives that include but are not limited to pigments, dyes, surfactants, nutritional ingredients, and drugs.

Benefits

It is an object of the present invention to replace current paintball formulations and soft-gelatin production methods by providing a new paintball, which is capable of encompassing a wide range of features and benefits, which those of ordinary skill in the art would appreciate as not being achievable with current formulations or production methods. These features include the capacity to manufacture paintballs and projectiles with greater precision, speed, and having similar or better quality than today's existing standards. Moreover the paintball of the present invention utilizes renewable, substitutable, non-animal derived shell materials and eliminates the need to employ hydrocarbon based fill materials, which are in short supply and are expensive.

Still another object of the present invention is to manufacture a paintball that is substantially cheaper to produce than the current gelatin processes, but which also yields new combinations and embodiments that are not currently achievable by today's practices. These include but are not limited to, encapsulating multiple fill materials that maintain their respective spatial orientation within a paintball during production without the aid of internal barriers and/or separate chambers. These fill materials may consist of or demonstrate, multiple colors having daytime and/or nighttime marking capabilities that provide a highly visible mark upon a target. Further, upon marking a target the fill of the preferred embodiment quickly becomes a gel and maintains it's form and does not "run" off of the target. These fill materials are also environmentally "friendly" and highly suitable for outdoor use where paintball is predominately played.

Forming, Filling, Joining

Gelatin paintballs of the prior art are formed and simultaneously filled in a closed system, in order to prevent fill materials from escaping shell cavities during production. The preferred embodiment of the present invention employs a fill that decreases in viscosity when shear stress is applied to it. While at rest this aqueous fill is in a semi-solid state and does not flow, even when in an inverted cavity. Thus, the fill can easily be introduced into the cavities of opposing pre-formed paintball shell halves without the concern for the fill flowing out or otherwise vacating the cavities. This facilitates a new production process wherein two equal shell halves of the desired shape and size are pre-formed and any time thereafter may be filled with the aqueous gel of the present invention.

The aqueous gel's resistive flow properties when at rest is highly advantageous, in that filled shell halves may be manipulated during production and oriented in any manner with respect to each other, without concern for the fill vacating the cavities. Each of these shell halves is filled independent of the other and may each have a different fill disposed in each cavity. After being filled the shell halves must then be joined together using a method that creates a complete seal between them. After these two shell halves are sealed together, they constitute a single capsule or projectile, with a single interior chamber.

The prior art fails to provide a joining means between two shell halves that are prefilled, wherein the fill does not interfere with the sealing surface area and the ability to get a complete seal between the shell halves. Further, the prior art also fails to provide a means for joining shell halves employing two different fills without the use of an internal barrier to create separate or multiple internal chambers. More particularly the prior art does not adequately provide a method wherein a fill material, pre-disposed within two shell cavities, does not flow out during the assembly of the two halves. It also does not teach a projectile that encapsulates multiple fills, sometimes having varying properties, that uses an air gap between them as a way to ensure the fill does not interfere with the sealing process.

Thus, the aqueous gel fill is further advantageous in that when in a semi-solid state its level can be intentionally recessed below that of the shell cavity surface, or sealing surfaces. The recessing of the fill is important so that it is not present in the sealing area, which constitutes the equator between two equal sized shell halves. The fill recessing prevents the fill from interfering with the joining means and the ability to create a complete seal. The recessing of the fills, as described herein, subsequently creates an air gap between both fills within the capsule at a point where the complete seal is being created during production. This permits a multitude of joining means during production, all of which are most effective when the fill is not present in the seal area.

Therefore, a principal object of the present invention is to provide an aqueous paintball for discharge from a paintball "gun" or other projection system. A feature of the aqueous paintball is an aqueous gel in an internal cavity of the paintball, the aqueous, shear thinning, gel containing a rheology modifier and other additives that include but are not limited to pigments, dyes, and surfactants. An advantage of the aqueous paintball is that the quantity and quality of a paintball is increased. Another advantage of the aqueous based paintball is that renewable, non-animal derived shell materials are used, while the usage of expensive hydrocarbon based filler materials is eliminated.

Another principal object of the present invention is to provide a method for manufacturing a plurality of aqueous paintballs that are substantially less expensive to manufacture than current processes. A feature of the method is the elimination of gelatin and the substitution of multiple aqueous based fillers that maintain their respective placement inside the internal cavity of the paintball without the aid of internal barriers and separate chambers. An advantage of the method is that multiple aqueous fillers of varying colors with daytime and/or nighttime marking capabilities can be disposed within one internal cavity in the paintball Separate Non-Mixing Fillers Paintballs manufactured using conventional rotary die encapsulation machines are limited to single phase fills by virtue of having one filling port per capsule die pocket. The rotary die process is further limited to single phase fills due to being a form-fill-seal process whereby the fill must be introduced between gelatin ribbons simultaneous to the capsule being formed in order to prevent the liquid from escaping the capsule prior to sealing.

In the present invention, two capsule halves are independently filled and then are subsequently assembled. The fill of the preferred embodiment employs a highly thixotropic, shear thinning agent, which renders an aqueous liquid into an aqueous gel when at rest. However if a mechanical force is applied to the shear thinning aqueous gel it liquefies and flows easily, again becoming a gel when at rest. Thus, the fill of the present invention is "injected" by means of a high shear filling nozzle, of which causes the gel to liquefy and flow easily into opposing pre-formed shell half recesses. Almost immediately upon coming to rest within the shell recess the aqueous fill then "re-gels" into a semi-solid state. Thereafter the semi-solid gel fill, resists flow, and through friction adheres to the inner wall of the recess. Thus, when the shell half is oriented concave down, the adhesion of the fill to the inner shell wall creates a resistive flow substantial enough to overcome gravity and does not vacate or displace within the recess.

The adhesion of the gel to the shell wall permits the independent filling of two equal size shell halves. Thus, a compatible fill material that is substantially a liquid when at rest can be introduced into a "bottom" shell half cavity. This bottom shell half is not manipulated during production in any manner that would cause the fill to vacate or displace within the recess. A matching "top" shell half recess would contain a highly thixotropic, shear thinning aqueous gel that is capable of being oriented in any position relevant to the bottom half for joining purposes during production. Thus fill materials, having either similar or differing viscosities, may be deposited independently in these two shell halves, but which ultimately are joined together to form a single capsule having a single internal chamber with both fills therein. As long as no mechanical force is applied to the closed system sufficient to decrease viscosity of the shear thinning gel temporarily, the fill phases will remain intact and separate allowing for a multitude of filler combinations.

Therefore, the adhesion and resistive flow properties of a gel fill to the inner shell wall within at least one of the two shell halves eliminates the need for physical barriers between capsule halves that would otherwise be necessary to separate two different fills. Moreover, a shear thinning fill is desirable since during production it can be introduced easily into shell half cavities and is still capable of providing the necessary "marking" effect of a paintball projectile. The stopping force of a capsule impacting a target after projection provides the necessary shear stress to cause the fill to liquefy and flow upon a target. The fill then quickly re-stabilizes to become a semi-solid gel that leaves a highly visible mark upon a target.

Therefore, another object of the present invention is to provide a method for manufacturing a paintball that replaces conventional rotary die encapsulation machines that are limited to single phase fills by virtue of having one filling port per capsule die pocket; the conventional machines being further limited by single phase fills due to being a form-fill-seal process whereby the fill must be introduced between the gelatin ribbons as the capsule forms to prevent the liquid from escaping the capsule prior to sealing. A feature of the present method is two shell halves that are independently filled and then assembled, thereby allowing fills of similar or differing viscosities to occupy the same cavity without the need for physical barriers between capsule halves.

Another feature of the present method is an aqueous gel that employs a shear thinning, thixotropic agent. The shear thinning thixotropic agent allows the aqueous gel to be a gel at "rest" and causes the aqueous fill to be liquid when a mechanical force is applied to the gel. An advantage of the thixotropic agent is that during production the aqueous gel is at rest and is disposed into the two shell halves in a gel state. Another advantage of the thixotropic agent is that when the two shell halves are assembled to form a paintball that is ultimately discharged from a paintball gun, the aqueous gel becomes a liquid upon impacting a target; whereupon, the aqueous gel quickly flows thereby marking the target, then quickly reverts back to a gel to maintain the mark upon the target irrespective of the orientation of the target.

Still another advantage of the thixotropic agent is that a plurality of aqueous gels varying in color may be employed to fill the shell halves and maintain their respective positions as long no mechanical force that would decrease gel viscosity is applied to the aqueous gels during paintball assembly, thereby allowing the aqueous gels to maintain their relative positions until a target is impacted; whereupon, a mark is formed with a design pattern that corresponds to the orientation of the aqueous gels inside the paintball.

The use of non-shear thinning gels are also capable of being employed, however the complexity of filling cavities during production, and the marking capabilities of a projectile may be adversely affected. More particularly an effective paintball fill must substantially "mark" a target after a paintball has been projected and the outer shell ruptured ejecting the fill upon the target. The effective area of marking can be affected by the viscosity of the fill, thus while a gel with non-shear thinning properties is capable of marking a target, the viscosity does not change substantially allowing flow of the fill. This flow increases the marking area necessary for eliminating a player from a game or exercise structure. The preferred embodiment of the present invention uses a shear thinning filler that decreases in viscosity upon impacting a target, providing a substantial mark for visual reference. Immediately thereafter the fill increases in viscosity to a gel state thereby resisting flow that would otherwise degrade the quality of the mark upon the target.

Multiple Colored Fills

As the sport of paintball has grown, the sale of paintballs themselves through large retail outlets has diminished the profitability of specialized industry businesses such as paintball parks and stores. In order for business owners to generate income they generally employ a "field paint only" (FPO) policy, mandating that players frequenting their establishment purchase paintballs at their parks. Gelatin paintballs employ a single phase fill and thus are limited in the number of color combinations (outer shell and fill) they can provide. In order to differentiate between paintballs purchased at parks and those through large retail outlets, it has become necessary to provide these field owners a product that is unique to their business.

Thus, the preferred embodiment of the present invention employs aqueous filler, with a rheology modifier capable of producing a highly thixotropic shear thinning gel, and preformed rigid half shells. Each half shell is filled separately with the aqueous filler and subsequently assembled together to create a paintball. This paintball is capable of advanced customization which is highly desirable to preserve the profitability of businesses within the industry.

Therefore, another object of the present invention is to provide customization options for park owners via a paintball that is capable of encapsulating multiple fillers having different colors, simultaneously and independently, without the use or aid of internal dividers, barriers, or multiple inner chambers to maintain separation. A feature of the present invention is an aqueous filler with a rheology modifier capable of producing a highly thixotropic shear thinning gel that is ultimately deposited in preformed rigid half shells. Each half shell is filled separately with the aqueous filler and subsequently assembled to create a paintball. Paintballs of the prior art can consist of two shell halves of different color or patterns only, and cannot employ fills of different colors unless internal barriers to create separate chambers are used. Further, patterns cannot be incorporated into the fills of hydrocarbon based fillers.

Thus, an advantage of the present invention is that the two shell halves can include different color/patterns, as well as a multitude of fills therein, each conceivably having their own color or a combination of colors to create a colored pattern, without the use of internal barriers to separate the fills, thereby providing a myriad of combinations far in excess of the number of paintball park owners. Another advantage of the present invention is that the encapsulation of multiple colored fillers, simultaneously do not intermix until the paintball impacts a target and the fillers are expelled, thereby providing color combinations upon a target for increasing the fun for paintball players. The simultaneous encapsulation of multiple colored fillers in a single cavity which do not intermix, until the paintball impacts a target and the fillers are expelled, without using internal barriers to create separate chambers is novel as those skilled in the art would appreciate.

Therefore, another object of the present invention is to provide a paintball that is capable of simultaneously encapsulating multiple fillers having different colors, without the use or aid of internal dividers, barriers, or multiple inner chambers to maintain separation. One method is described hereafter, and is not intended to limit the scope of protection accorded this invention.

Rigid half shells, representing the top and bottom or left and right halves of a sphere, are formed from a biodegradable, water-insoluble polymer, and filled independently with at least one different aqueous fill for each respective half. Each of the aqueous fillers includes a rheology modifier capable of producing a thixotropic shear thinning gel, and therefore causes the filler to become substantially a gel when at rest. Other additives may also be utilized in each filler including but not limited to surfactants, drugs, nutritionals, neutralizing agents. However each fill includes a different colored dye, pigment, or glow phosphor to distinguish it from the other filler once introduced into the shell half.

The prepared aqueous gels are then introduced by means of a high shear filling nozzle, (or other adequate method), which liquefies the gel filler thereby allowing it to flow into the recesses of the rigid half shells until the appropriate or desired quantity is reached. The filler thereafter quickly re-gelling and self-leveling or being leveled manually with excess removed. The now filled rigid half shells are assembled together to create a complete spherical projectile and the volume of combined fillers may be less, but is not greater than the combined total internal volume of the half shells.

During the capsule assembly process, one half of the capsule may be inverted and aligned with the mating capsule half. The halves are then brought together, and a seal is formed between the mating/interfacing surfaces. The fill in the inverted capsule half is held in place by the flow properties of the thixotropic gel and the adhesion forces between the shell material and the gel. In the described method, the now assembled and complete paintball would have two independent fill halves of different color. These separate fillers do not intermix because of their respective rheological properties. The separated, colored, aqueous gel simultaneously encapsulated into a single inner chamber maintains separation indefinitely until such time as the gel temporarily liquefies. This is due to the shear energy imparted upon the fill system during an impact of the paintball on a target, where the outer shell fractures, and expels the filler, thereby leaving a multi-colored "mark" upon the target.

Further, there is no limit to the color combinations that can be inserted into each respective shell half. Each half shell may be spatially divided into half again, creating quarter segment color combinations within a fabricated paintball. Segments numbering greater than four can be configured within a paintball without using internal barriers between fills of different colors. The aqueous gel of the present invention may also be introduced into each independent shell half in layers, horizontally or vertically oriented, or agitated to create swirl or "tie-dye" like patterns in the fill which further differentiates projectiles to offer advanced customization not found in the prior art paintballs.

As the independent shell halves are filled with aqueous gel, it is also feasible to orient patterns, such as stripes, lines, etc. in a similar or opposing manner. When the two shell halves are assembled together, the fills presents patterns perpendicular to each other. For example, the aqueous filler of one half may be injected such that pigmented stripes appear to run parallel to the seam area of a shell half, while the opposing half may have pigmented stripes that are oriented perpendicular to the seam area. The orientation of this filler and/or patterns therein, may serve a functional purpose with regard to marking, such that a unique mark is left upon a target, but may also serve as a unique aesthetic feature to provide highly customizable projectiles to end users. This method of customization is not possible with typical paintball manufacturing processes.

A benefit of the aqueous gel as described herein, is that additional internal capsules, material, film or barriers to create separate inner chambers as disclosed in the prior art is not needed to encapsulate multiple fillers for the present invention. These fillers may possess various distinguishable combinations of colors, dyes, pigments, or phosphors despite the fact that they occupy the same single inner chamber.

Therefore, another object of the present invention is to provide a method for fabricating a paintball that includes a step wherein varying aqueous gels fill two separated halves of a paintball. A feature of the present invention is that the aqueous gel is sufficiently viscous to allow at least one of the halves to be inverted during assembly of the paintball such that the aqueous gel in the inverted half shell remains in the recess of the inverted half shell.

An advantage of the present invention is that the method of fabricating the paintball is much simpler and more economical than prior art methods. Further, additional internal capsules, material, film or barriers to create separate inner chambers as disclosed in the prior art are not needed to encapsulate multiple fillers for the present invention. These fillers may possess various distinguishable combinations of colors, dyes, pigments, or phosphors despite the fact that they occupy the same single inner chamber.

Reflective Backboard

One such combination of different aqueous fillers, includes the use of a colored aqueous gel in one shell half capable of marking during a daytime paintball game or exercise, and a second aqueous gel deposited in a second shell half, that has dispersed within it a glow phosphor, capable of being charged and illuminated for marking during nighttime paintball games or exercises. In this combination the aqueous gel half for daytime marking is opaque and employs a brilliant color dye such as white or yellow.

This brilliant colored fill acts as a diffuse surface or "reflective backboard", reflecting light rays generated by the excited glow phosphor outward toward the projectile half containing the glow phosphor. Therefore rather than this light diffusing through the entire projectile and thus a larger outer shell surface area, it is reflected through a transparent shell half containing the glow phosphor. This increases the radiance, or brilliance of that glow phosphor; radiance being commonly defined as the amount of light that passes through an area. This allows for a more intense visible light with one-half the quantity of phosphors. Therefore, this combination provides a single projectile suitable for both daytime and nighttime paintball games, and also reduces the cost to produce a glow-in-the-dark projectile.

An additional combination of fillers may also include an aqueous gel prepared in the same manner described herein. Within one fill is disposed a glow phosphor, and in the opposing fill half a photo protein, which reacts with ions and most notably calcium, and is used to generate visible light. Thus this combination is useful for a nighttime or low light game exercises. As the glow phosphor in one fill half is activated it generates a visible light that can be used for reference during its projected flight path. However, after impacting upon a target the subsequent expulsion of the aqueous liquefied gel containing the ion reactive photo protein generates a secondary light effect of different color.

Thus, another object of the present invention is to provide a method for manufacturing a paintball that may be used in the daytime or nighttime. A feature of the method is to deposit glow power in the aqueous gel filler thereafter depositing the fill containing glow powder in at least one half shell. Yet another feature of the method is to deposit glow powder in both of the half shells and aqueous gel fillers deposited in the two half shells. An advantage of the method is that varying levels of luminescence may be selected by the paintball user to provide sufficient light emission from the paintball for each paintball park.

Printing Fill

Further customization with the aqueous gel filler is possible, such as "printing" shapes, words, symbols, logos, etc into the shell halves. This is accomplished by employing precise, high shear filling equipment with multiple nozzles for each independent shell half. The fill nozzle, being attached to a control arm, with lateral, linear, and vertical movement capacity, orients itself above each half shell cavity. As the control arm dispenses fill and simultaneously moves, various colors are inset within the cavity at predetermined time intervals relevant to the cavity space. This method results in placement of multiple layers of various fill colors. These fill layers, when complete, coordinate together to form a three-dimensional shape. This is due to the orientation of similar fill color layered upon each other within the three dimensional space, giving the appearance that an object is suspended within the filler itself.

Further, the employment of any of the aforementioned multiple colored aqueous gel fill combinations or patterns, does not prevent or inhibit the concurrent use of multiple colored outer shell halves, the inclusion of glow phosphors in the outer shell or within an inner or outer film coating, or using a soluble outer shell material and inner hydrophobic film barrier. The outer shell colors, combinations of colors, or patterns do not degrade or prohibit the use of multiple colored fills, except where outer shell transparency is desired to present a shape or pattern in the fill itself, or to allow optimum charging of glow phosphors, which may be included from time to time in the aqueous fill.

Still another object of the present invention is to provide a method for manufacturing a paintball that configures three dimensional forms in a paintball half shell. A feature of the method is a fill nozzle that can be selectively disposed in a paintball half shell to provide a three dimensional predetermined configuration. An advantage of the present method is that a myriad of forms representing respective users or paintball parks can be included in a paintball half shell.

Non-Running Marks

As described herein, the essence of a paintball game or military exercise is the use of projected paintballs, generally by way of an air powered projection system, to deliver an inner filler material that is visible when ejected from a fractured outer shell, disposed upon a target, and leaving a visible "mark" for the purpose of elimination. Now, given the general, functional purpose of the inner filler, it is known to those skilled in the art to attempt to utilize fill materials that leave good visible marks to facilitate elimination. However, the prior art employs materials such as polyethylene glycols, oils and other fillers, which after ejection and marking of a target, are subject to "flowing" or "running", degrading the visible quality of said mark.

Therefore, it is an object of the present invention, to employ aqueous gel fillers that are stable, insofar as they maintain a semi-solid state and resist flow, but upon experiencing shear stress from target impact the filler thins, thereby allowing flow. The benefit of this "mechanically stable when not in use" state is that aqueous filler flows only when functionally required, such as during production or pursuant to impact upon a target. This impact causes the aqueous filler to leave a substantial, visible mark upon the target. The thixotropic aqueous filler nearly immediately returns to a semisolid state thereafter which resists flow and leaves a mark that indefinitely maintains the shape it assumed upon contact with the target until such time as it is cleaned away by wiping, precipitation, laundering, etc. Thus, a benefit of the present invention is that it provides a mark upon a target, which maintains its shape for visual reference and does not flow or run off, increasing the opportunity to eliminate a marked target from an exercise or game structure.

Moreover, the viscosity of the aqueous filler of the present invention is not affected by temperature which can cause a decrease in viscosity in other common paintball fills. This decrease in viscosity is vital to filler and paintball performance since thinning can cause a mark left by such an impact to flow, run, or otherwise degrade upon a target. Another benefit of employing an aqueous fill whose viscosity is not affected by temperature is that the marking quality of the inner filler is always maintained. The marking quality is the extent to which the fill leaves a mark upon a target. Lower viscosity fills tend to leave a less substantial and thus less visible mark with regard to size and appearance. Quality marks have a good diameter relevant to the projectile size and fill volume, and yet are concentrated enough that the colored pigments therein are easily recognizable and do not blend in with a participants clothing or equipment. The paintballs of the prior art employ fills, that when subjected to high temperatures, decrease in viscosity, thus reducing the quality of the marking capability. In addition, paintballs of the prior art require very strict storage conditions to avoid exposure to high temperatures or moisture. The paintball of the present invention eliminates the need for stringent shipping and storage conditions.

Therefore, it is an object of the present invention to provide a method for manufacturing a paintball that utilizes an aqueous fill that readily flows upon a target, but that after a short time period and after a sufficient quantity of surface area of the target has been covered by the aqueous fill, becomes relatively viscous and maintains coverage of the surface area.

Suspension Properties

Yet another object of the present invention is to employ an aqueous gel, which when at rest is semi-solid and mechanically stable and far more capable of suspending particles indefinitely. These particles include but are not limited to, dyes, pigments, and phosphors, which can be included in greater quantity, larger size, heavier weight, or greater density than current hydrocarbon based fillers of the prior art. The higher viscosity aqueous gel also facilitates the ability to encapsulate large particles, or even macro encapsulate a multitude of smaller (outer diameter) projectiles within a single projectile. These smaller projectiles may also encapsulate a fill, powder or other substance within it.

The aqueous gel having a higher viscosity than the fillers of the prior art inherently possesses anti-settling properties, which greatly increases the resistance of these large particles or macro encapsulated projectiles from settling within the projectile. The settling of these particles within the projectile could result in a "wobble" or "curve" in the trajectory. Thus a filler that can indefinitely suspend heavier and/or larger particles results in a projectile with a "straighter" and more consistent flight path. Further, the viscosity of the aqueous gel is unaffected even when exposed to temperatures exceeding 85 F, and thus is capable of maintaining suspension in conditions not sustainable for common paintball fills.

Evaporative Fillers

Another disadvantage of paintballs in the prior art is the use of non-aqueous fillers, such as hydrocarbons and low water content based materials, which includes polyethylene glycols and mineral oils which do not readily evaporate. The result is a filler material that is left upon targets, structures, and equipment, indefinitely or until intentionally cleaned away. The use of these hydrocarbon based fillers at indoor paintball facilities prevents natural precipitation from washing away or diluting the materials deposited. This creates a dangerous environment for players as flooring surfaces remain slippery and greatly enhance the opportunity for injury to a person participating in indoor paintball games or exercises.

Therefore, another object of the present invention is to provide a paintball that, after marking of a target, evaporates relatively quickly. A feature of the paintball is an aqueous fill material. An advantage of the paintball is that the time and cost to clean-up an area used to conduct paintball games is substantially reduced. Another advantage of the paintball is that the evaporation of the fill substantially reduces the safety hazards associated with material being left on a playing surface, such as indoor flooring or outdoor fields.

Reducing Water Vapor Transmission Rate of Outer Shell

Still another object of the present invention is to prevent or greatly reduce the evaporation of the aqueous fill through the outer shell prior to marking a target. Otherwise, this would result in a projectile that is diminished in weight as a result of water loss. This loss of water could result in surface anomalies to the outer shell or defects to the shape of the paintball. Moreover, any significant loss of mass as a result of water loss could also affect the trajectory of a projected paintball. The drag and wind effect upon a substantially lighter projectile may prevent a paintball from traveling an adequate distance and marking a target. Another possibility is that the paintball may not generate enough impact force to fracture the outer shell and expel the fill as result of the loss of mass.

Thus, the present invention may incorporate additives, including but not limited to nano-particles such as organiphillic montmorillonite ("MMT") nanoclay, within the biodegradable polymers of the outer shell of the paintball. These particles serve to increase the overall hydrophobicity of the outer shell material, thereby reducing the water vapor transmission rate ("WVTR") of the outer shell material. This prevents or greatly reduces water loss from the inner filler as a vapor through the outer shell, preserving the mass of the fill and shape of the paintball capsule. Further, this improves the shelf life of the projectile and ensures the consistency of marks left upon a target.

Other suitable additives with similar effect may also be employed, so long as they are compatible with the outer shell material and do not degrade the ability for the outer shell to fracture subsequent to an impact upon a target. If an additive to the outer shell polymer is not desirable, a hydrophobic barrier applied to the inner or outer surface of the shell material, as described herein, may also be employed to reduce the WVTR.

Glow-in-the-Dark Outer Spray Coating

It is an object of the present invention to employ functional spray coatings upon the outer shell. In particular, the paintball of the present invention is capable of receiving a solvent spray coating, or being dip coated with a film depositing mixture. Suitable polymers for coating applications include celluloses or other biodegradable, solvent soluble polymers. One such functional coating includes a mixture of hydrophobic ethyl cellulose, dissolved within suitable solvent(s), hydrophobic fumed silica, plasticizer, and a glow phosphor. The assembled paintball of the present invention is then spray coated, dipped, or has the mixture poured over it. This is performed as a post production process wherein upon evaporation of the solvent, a thin film coating containing glow phosphors remains upon the outer shell.

This glow-in-the-dark coating would be useful where a transparent outer shell and/or inner filler, is not viable or desired. The color of the outer shell and inner filler is relevant because the greater their transparency, the easier ultra-violet light energy penetrates, thereby charging glow phosphors therein more effectively. Thus, paintballs comprising a colored fill and colored outer shell, which also requires a glow-in-the-dark tracing effect, would employ this outer coating with glow phosphors as a useful alternative.

Further, glow phosphors or pigments, which may not be compatible with an inner aqueous filler, and/or a particular outer shell polymer, can still be employed in combination with any of the embodiments of the present invention. This outer glow-in-the-dark coating serves as a method to apply phosphors and render a paintball projectile useful during night games, irrespective of its outer shell construct or inner filler formulation.

Coating to Reinforce Seam and Improve WVTR

The outer spray coating described herein and applied to assembled paintballs may also be applied directly to the seam area in order to reinforce the bond between the top and bottom shell halves. While creating a stronger bond between the top and bottom halves, this also serves to ensure there are no defects or gaps between the halves that may permit evaporation of the inner filler to occur. These breeches in the seam area can also result in seeping or leakage of the filler, this coating also prevents that from occurring. Most important is that this coating ensures that the two halves do not separate prior to impacting a target subsequent to projection from a paintball gun or similar device. This outer coating can use film forming, preferably biodegradable materials such as ethyl cellulose and applied until the desired thickness is achieved. The application can use a spray, dip, or other compatible coating method.

Further, this outer coating can be formulated and applied to the entire paintball of the present invention to eliminate or minimize the water vapor transmission rate of the outer shell material. This coating ensures that moisture is not lost by evaporation through the outer shell, thereby preserving the filler for the intended marking effect.

Glow-in-the-Dark Inner Spray Coating

It is also feasible to apply a functional coating to the inner surface of the outer shell half, so long as it does not interfere with the ability of the two halves to seal together. The inner spray coating utilizes similar materials as the outer coating method described herein. The inner coating could also contain hydrophobic ethyl cellulose, dissolved in a solvent compatible with the outer shell polymer. Within the film mixture a glow phosphor that is water-insoluble or has low water solubility is included, generally in an amount of 5-10% by weight of the coating being applied, and a dispersing agent.

This coating is applied to the inner surface of the two rigid half shells prior to the introduction of the inner filler, such that it acts as a water barrier between the outer shell and inner aqueous filler. Within this construct it is optimal, but not necessary, that the outer shell be transparent, in order to allow ultra violet light energy to penetrate and activate the phosphor to glow. Greater transparency of the outer shell in this embodiment allows more penetration of ultra-violet light, resulting in more effective excitation of the glow phosphor. This facilitates a brighter, visible glow for the purpose of creating a tracer effect during low light or night games.

Another combination employing an inner glow-in-the-dark coating is the use of a transparent outer shell and colored inner filler. The filler is generally dyed a brilliant color in order to reflect the light generated by the excited phosphor outward, pursuant to the reflective backboard embodiment described herein. This reflective backboard facilitates a more efficient glow from the activated phosphor, since the light is not diminished as it radiates toward the inner diameter of the paintball projectile.

Yet another combination uses a transparent outer shell, and an inner glow-in-the-dark coating upon the inner surface of the outer shell. Disposed within each shell cavity is an inner fill, which may be transparent, the same or different in color, but having dissolved within it an ion reactive photo protein. This renders the inner aqueous filler ion reactive, such that when it is ejected from the outer shell and comes into contact with a target it generates visible light, effectively marking that target for elimination from an exercise or game structure.

Two Fills, Two Viscosities

Still another embodiment of the present invention employs, a first aqueous filler employing a shear thinning thixotropic agent, to create a mechanically stable gel when at rest and possessing a high viscosity, which is disposed in a first outer shell half. The flow properties and adhesion force of the first aqueous filler prevents it from flowing or running out of the first rigid shell half. This ensures that inverting it is feasible and allows it to act as a "top" half for assembly. A second fill, possessing a lower viscosity, and which may or may not be aqueous but nonetheless is compatible with the first fill is disposed into a second outer shell half.

The second shell half containing the second fill, is not inverted during assembly. The viscosity of this filler is capable of a higher flow rate and therefore this second shell half must remain static and level. Thus the second shell half acts as a "bottom" during the assembly process until such time as the two halves are sealed together at their interfacing surfaces. After assembly the two compatible fillers are encapsulated within the same single inner cavity, without the use or aid of internal barriers to create separate chambers. The high viscosity of the aqueous gel prevents it from flowing into the lower viscosity component, which results in separated fills in respective shell halves and both within the same single cavity.

This combination further allows for fills of varying densities to be encapsulated within the same single chamber. One fill having a greater density is therefore heavier, than the filler of lesser density. An assembled projectile of this combination would render the capsule heavier on one side. This asymmetrical weight distribution thereafter causes the capsule to "tumble" when projected. This is advantageous because the trajectory of a round projectile that tumbles results in a curve.

The direction of the curve can be indicated by providing a feature on the shell half containing the filler of greater density. This provides a reference for the curve the projectile will take given its relative position just before projection. Thus a capsule with the curve indicating feature that is loaded into the breech of the projection system, provides guidance relevant to how the projectile will curve. This is useful if the individual using the projectile desires a curve in a particular direction.

Other combinations of fills in this embodiment may employ a powder, such as a pepper powder in the lower shell half, and an aqueous gel with permanent marking dye in the top shell half. These multiple phase fill combinations are useful for law enforcement and/or military use for crowd and riot control purposes.

Shell Fracture Enhancing Features

Still another object of the present invention is to provide a new paintball projectile, which fractures more readily and consistently than current gelatin paintballs. The employment of thermoplastic resins, formed into sheet stock and used in a thermoforming machine to form a web of rigid half shells, is capable of incorporating within the thermoforming mold cavities of said machine, embossing features such as words, letters, logos, patterns, etc. These features, generally would have a depth or height of 0.001-0.005 inches that corresponds with the curvature of the mold to maintain this depth, and would either be a positive or negative imprint within the thermoforming cavity.

The thermoforming cavity causes the polymer web to form a half shell shape when heated, softened, and pulled into the cavity by means of vacuum and/or plug assist methods. As the softened thermoplastic is pulled and/or pressed against the mold cavity with the positive or negative embossing, this impression is left upon the outer shell, such that when the web of rigid half shells is removed, an opposing impression remains as a permanent feature of the outer shell.

These positive or negative ridges, patterns, or imprints, provide a customizable aesthetic feature, but more importantly provides a functional feature that creates "stress" points, within the outer shell. This ensures that when a paintball is projected, the outer shell fractures more readily and consistently upon a target. The essence of a paintball game or military exercise is to eliminate other participants from the match by marking them, thus consistent fracturing of the outer shell is vital to maintaining the integrity of the match. The ability of the present invention to apply fracture enhancing features to the outer shell is not known in the prior art gelatin paintballs, but can easily be incorporated into the assembly methods of the present invention such that the trajectory of a projected paintball is maintained.

Gap Filling

Another object of the present invention is to provide a sealing method which does not require shell material to be present beyond the outer diameter of the assembled paintball at the seam area. Some prior art paintball manufacturing techniques do not account for the exclusion of a perpendicular protrusion or protuberance of shell material around the equator or seam area of the paintball. This protuberance is commonly referred to as a "flange".

After thermoforming the polymer, the resulting shell halves formed are disposed such that a concave portion is down forming a base, while the open portion is up providing a recess to receive fill material (see FIG. 5A, 206). The shell halves include annular walls (see FIG. 5A, 212) that provide an interfacing surface for the joining of the shell halves. Each hemisphere configured shell half includes a radial curvature adjacent to the annular walls. This curvature is located at the interfacing area of the formed shell half, such that when the top and bottom shell halves oppose each other and are bonded together to form a single interior cavity, the interfacing surface areas come into contact at a point near the outer diameter of an edge portion of the annular walls. A cross section (see FIG. 10D, 222) inspection of the inner spherical wall of each shell half reveals that the curvature of the inner wall as it transitions from the annular wall forming interfacing area departs from a spherical configuration thereby creating a "seam gap" extending from joined portions of the annular walls of the shell halves to the inner spherical wall of the joined shell halves. In order to maintain a complete seal around the interfacing area, the paintball must be cut at a point outside of the outer diameter to ensure that enough surface area is in contact between the two joined shell halves to maintain a strong bond. The result is that the projectile has a flange. While this projectile can be used, it is not optimal for overall performance.

Therefore it is an object of the present invention to provide a flangeless paintball. Another object of the present invention is to provide a method for manufacturing a plurality of flangeless paintballs. A feature of the present invention is to supply aqueous fill to each shell such that the aqueous fill is reduced below an annular wall forming a joining surface of the shell. The aqueous fill is reduced or recessed to a predetermined level by evaporating moisture in the fill.

In the preferred method of the present invention, a paintball is assembled by thermoforming two shell halves, then filling each with an aqueous gel, followed by removing any excess fill quantity such that the fill is level with the surface of the annular wall. The fill now level with the annular wall is exposed to very dry air. This dry air evaporates water from the aqueous gel, causing it to recess or depress slightly within the shell cavity, in the preferred range of 0.001"-"0.020". This creates excess space within the cavity so that an adhesive can be disposed upon the annular wall and ultimately extend past the spherical inner wall and into the inner cavity or "bowl" of the shell half without causing the inner cavity to exceed its maximum volume. Therefore, the recessing of the fill in the shell half cavity results in a space maintained between first and second fill levels when two shell halves are assembled. The maintained space prevents the fill from engaging the seam gap at the annular wall or joining area so that the fill does not interfere with the method to join the top and bottom shell halves This reducing or recessing of the fill within the cavity is advantageous in that a high viscosity adhesive can be delivered precisely to the surface of the interfacing area without engaging the fill. Further, the slight recessing of the aqueous fill prevents the fill from compressing the adhesive and forcing the adhesive out of the seam gap that the adhesive is intended to fill. This seam gap occurs after joining the top and bottom thermoformed shell half together, the seam gap being located radially adjacent to the joined annular walls of the two shell halves. In this method, the precise placement and viscosity of the adhesive is relevant because the adhesive must create a bond between the shell halves from the outer diameter of the seam area inward into the inner cavity of the joined shell halves at the seam. This method permits the excess flange to be removed so that the outer diameter at the seam is smooth and flangeless for optimal performance and maintains a strong bond/seal between the top and bottom shell halves.

Subsequently, this method uses a buffer of air between the two aqueous gel fillers in their respective shell halves to facilitate joining the shell halves together. Over filling of the projectile, wherein the fill interferes in the interfacing seam area, does not permit a sufficient bond between the shell halves to occur rendering the paintball useless. Thus, the adhesive and fill of the present invention cooperate to create a maintained seal between the top and bottom shell halves that lasts until the paintball engages a target.

An alternative method of disposing fill inside each shell half is to dispense a predetermined amount of fill into each shell half cavity that does not consume the entire volume of the cavity. Thereafter the fill is leveled by vibrating the shell half sufficiently to cause the viscosity of the aqueous gel to lower temporarily. This results in the settling of the fill within each cavity, wherein the level of the fill is lower than the surface of the annular wall of the shell half. Thereafter, the fill again becomes viscous and the shell halves can be oriented in any manner without having the fill interfere with the joining of the shell halves.

Adhesive Annulus

An alternate method for producing a flangeless paintball and eliminating the gap between the annular walls of the two shell halves, is to form an annulus or "gasket" upon the annular walls using an adhesive, resin, hot melt, or other suitable substance. This annulus creates a larger interfacing surface area on one or both shell halves after the cavities have been filled. The annulus creating material is placed just outside the annular wall and upon the outer spherical wall of the shell half, the adhesive being applied inwardly beyond the inner spherical wall of the shell half. Thereafter it is allowed to cure, prior to joining the two halves together. After curing it adheres to the seam area of each shell half and extends into the cavity, potentially resting on top of the filler, but creating a horizontal surface area on the upper and lower shell halves. This horizontal surface area or annulus provides supplemental surface area with which to bond the two halves together. While using an adhesive is the preferred method, other materials such as resins or hot melts may also be used to create the additional surface area.

Therefore a preferred method includes filling hemisphere configured top and bottom shell halves side by side with the recesses up. An ultra violet curable adhesive is applied to both shell halves at a point just outside the outer diameter and extends into the inner diameter in a preferred range of approximately 0.010"-0.030" such that it rests upon the aqueous filler but does not completely cover the fill to create a gasket type barrier. Thereafter the adhesive is exposed to the required U.V. light so that it quickly cures, bonding to the shell and creating a ring of hardened adhesive on top of the filler of both shell halves. These hardened rings now become the interfacing surface area of each respective shell half. Prior to being adhered together the annulus in the shell half that will act as the "top" is sprayed with an adhesive accelerator. The opposing annulus will have disposed upon it an adhesive that is rapidly cured by the accelerator. One shell half is then aligned to oppose the other half so that the interfacing annulus surfaces can come into contact and subsequently bond together. The now assembled paintball is then cut or otherwise removed from the webbing.

Alternate methods include filling both shell halves and laying down hot glue or hot melt of polymer which cools to form hardened rings of supplemental interfacing material which are subsequently adhered together. This method also results in a buffer of air between the aqueous gel fillers in their two respective shell halves and prevents over filling of the projectile.

Intermediate Layer

Another method for assembling the top and bottom shell halves together includes introducing a third layer of material in between the two sheets of formed cavities. This "middle" layer, is introduced as a sheet of material that has one or more holes punched through it at preselected locations. The hole in the middle sheet has a diameter that is smaller than the outer diameter of the formed shell half it is affixed to. The opposing half is then brought down upon this layer so that all three webs are sealed together either by adhesive, hot melt, hot glue, heat, etc.

A method for introducing a middle layer of material is to thermoform, upon separate sheets of suitable polymer, a matrix of shell halves that will constitute a top and bottom half. The cavities are then filled with the aqueous gel of the present invention, thereafter an adhesive is applied on the interfacing surfaces of both top and bottom shell halves at a point just beyond the outside diameter and extending inward just inside the inner diameter. The middle layer of material then has holes punched through it which have an outer diameter that is smaller than the inner diameter of the shell half cavities. The middle layer then has an adhesive accelerator applied to both its top and bottom surfaces. This middle layer is then placed upon one of the shell half sheets, such that the hole rests symmetrically and entirely within the inner diameter of the matching cavity. The opposing shell half is then aligned in order to be adhered to the middle layer in the same manner. Once aligned, it then is pressed against the middle layer and adhered, sandwiching this layer between the two halves. After the adhesive cures, the now assembled paintballs are cut out of the polymer sheets so that no flange exists on the paintballs.

This middle layer may or may not consist of the same material as the outer shell material depending on the intended use and desired performance. Further, instead of an entire sheet as a middle layer, a freestanding, precut annulus may be precisely located in between the two shell halves upon the interfacing areas. This method also provides an air gap, after joining the two shell halves, that is located between the two fills in each recess, the air gap being no less than the thickness of the middle layer sheet being used.

Thermoformed Undercut

Further, the thermoforming molds may possess an undercut feature within each cavity, which assists during the thermoforming process in displacing a portion of the PLA toward the inner cavity. The displacement of this material is located at the interfacing area which will be used to create a bond between the top and bottom shell halves. This undercutting method displaces a suitable amount of material to provide an additional amount of surface area to create a stronger bond between opposing shell halves. This also recesses the seam area slightly within the outer spherical shell wall to ensure that it is not cut off during the removal of assembled paintballs from the polymer web. If the seam area is compromised or weakened it could cause separation of the two shell halves, rendering the paintball useless.

After the assembled paintball halves are removed by way of cutting or punching from the webbing, this recessed seam reduces or eliminates the need for a flange which may extend beyond the outer diameter of the shell halves. Thus, this method provides suitable contact between the surface area of the two shell halves to ensure a sufficient bond occurs. If it is desirable to have a flange, 0.001" or greater in size, then an undercut is not employed during thermoforming.

Two Shell Materials

It is also feasible, using the aqueous gel fill and the various assembly methods of the present invention to adhere or seal together two dissimilar outer shell materials. For example, if desired, two different formulations of shell materials may be extruded and thermoformed to form the respective top and bottom shell halves. Thereafter both halves are filled with aqueous gel, and then sealed together using any of the methods described herein.

Combinations of shell half materials are limited only by compatibility with inner fill materials, desired performance traits, and intended use. These materials include but are not limited to either pure mixtures or blends of biodegradable polyesters, starch copolymers, polyvinyl alcohol, unstabilized polyethylene, polypropylenes, polylactic acid, or polystyrene. An example of a blend may be polymers such as polypropylene/starch polymers, or various blends of polylactic acid, etc. Thus, one shell half may be composed solely of polylactic acid, and the other shell half may be the polypropylene/starch polymer blend. These halves are thermoformed to similar shell size, filled with the aqueous gel and are sealed together using a compatible adhesive, heat seal, welding, or other suitable sealing method.

Inverted Filling

As an alternate method of filling, it is also feasible to inject the aqueous gel filler into a shell cavity while it is inverted, that is, the recess opening is facing downward (concave down). A shell half, that is concave down or has the annular walls perpendicular to the ground can still be filled using the aqueous gel of the present invention. The aqueous gel utilizes an adhesion force and resists flow, thus allowing the cavity to be inverted while being filled with the aqueous gel.

Heat Sealing Method

As an alternate method of joining the two shell halves, a heat sealing system may be employed instead of an adhesive. The aqueous fill of the present invention provides substantial flexibility with regard to the joining means. In particular, the adhesion force and flow properties of the shear thinning gel filler ensure that it does not vacate, displace, or otherwise flow from the cavity it is injected into during production. Moreover the methods for recessing the fill within those cavities, in a preferred range of 0.001"-0.020" as previously described, ensures that the fill is vacant from the interfacing surface areas and thus does not interfere with the joining means employed for the two shell halves.

Therefore, another alternate method for producing a paintball of the present invention is to employ heat to cause the outer shell material to flow together at the interfacing surface areas to create a bond and a sufficient seal. In this method the capsule halves are formed using the thermoforming process described herein. The cavities are then filled with an aqueous gel, then the excess gel is removed. The aqueous gel filler in the cavities is then caused to recess, either by means of vibration and leveling, or by leveling and thereafter exposing to dry air or heat to evaporate away moisture until it is the fill level is reduced sufficiently. The two shell halves, now with recessed fill in their respective cavities, are then brought together to oppose each other such that when the interfacing surfaces come into contact, they form a single inner chamber. Within this chamber, the aqueous gel fillers remain in the respective cavities of each shell half, resulting in an air gap separating the two aqueous gel fillers, which corresponds to the combined size of the distance of each recessed fill surface from the annular walls providing the sealing surface.

This air gap ensures that the fill is not in the interfacing area, which is significant in a heat seal process since the fill of the present invention is primarily water, and water acts as a heat sink. As a heat sink, the filler in the chamber acts to dissipate heat that is applied to the outer spherical wall of each shell half from a heat source. Thus, the paintball surface area of the annular wall has an adjacent air gap and correspondingly has no heat sink available to diffuse heat. This allows the shell material at the seam area to melt and flow together at a lower temperature than at any other portion of the outer shell. This prevents damage or surface defects from forming on the remaining portions of the paintball as the filler inside diffuses heat and increases the melt temperature of the polymer shell material.

In this method the polymer at the interfacing surfaces areas is heated, melted, and directed inward such that a complete and sufficient bond is created for the capsule to survive projection from a paintball discharge device. It is also desirable to create a relatively small bead of material on the inner spherical wall of the paintball at the seal area. This bead is a combination of polymer from each shell half and rests within the air gap between the upper and lower recessed aqueous gel fillers. The bead provides added holding force to prevent the shell halves from separating when the paintball is discharged from a paintball discharge device.

Simultaneous Manufacturing of Predetermined Quantities of Paintballs

Another object of the present invention is to provide a method for manufacturing multiple paintballs simultaneously. A feature or step of the multiple paintball method is selecting one of the above methods for manufacturing a single paintball, then building an assembly line for manufacturing multiple paintballs based upon the selected method for manufacturing a single paintball. An advantage of the multiple paintball method is that it utilizes a proven method of manufacturing a single paintball, thereby minimizing the cost and time to produce an assembly line that provides multiple paintballs meeting rigid specifications.

Another object of the present invention is to provide a method for manufacturing a predetermined quantity of paintballs simultaneously. A feature or step to manufacture multiple paintballs is providing first and second sheet rolls fabricated from an extruded polymer, the first and second sheet rolls unraveling upon first and second conveyor lines. Other features or steps are: providing first and second heated thermoforming molds or plates, providing a sheet thermoforming press to form a web matrix of half shell portions, providing an aqueous based shear thinning gel to fill the half shell portions, filling the half shell portions with a precisely measured amount of aqueous gel, removing excess aqueous gel from the half shell portions, reducing the level of aqueous gel in the half shell portions to allow an adhesive to be applied to annular portions of first and second half shell portions, inverting and disposing a matrix of second half shell portions congruently above a corresponding matrix of first half shell portions, and separating the now joined and sealed first and second half shell portions from a web matrix to form a predetermined quantity of paintballs simultaneously. An advantage of the method for manufacturing a predetermined quantity of paintballs simultaneously is that the method is easily repeated until a required total number of paintballs have been manufactured. Other means for joining the first and second shell half matrices may also be employed instead of adhesive.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

Figure 11A:
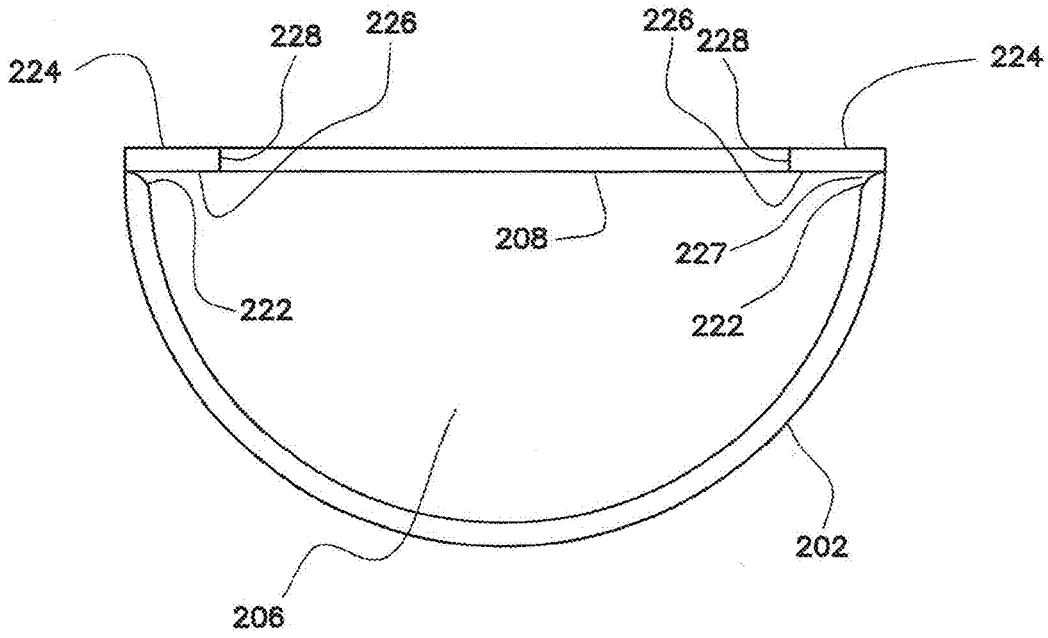
FIG. 11A is a front elevation sectional view of the first shell portion 202 of FIG. 10A, but with an annulus 224 added in accordance with the present invention.
Figure 11B:
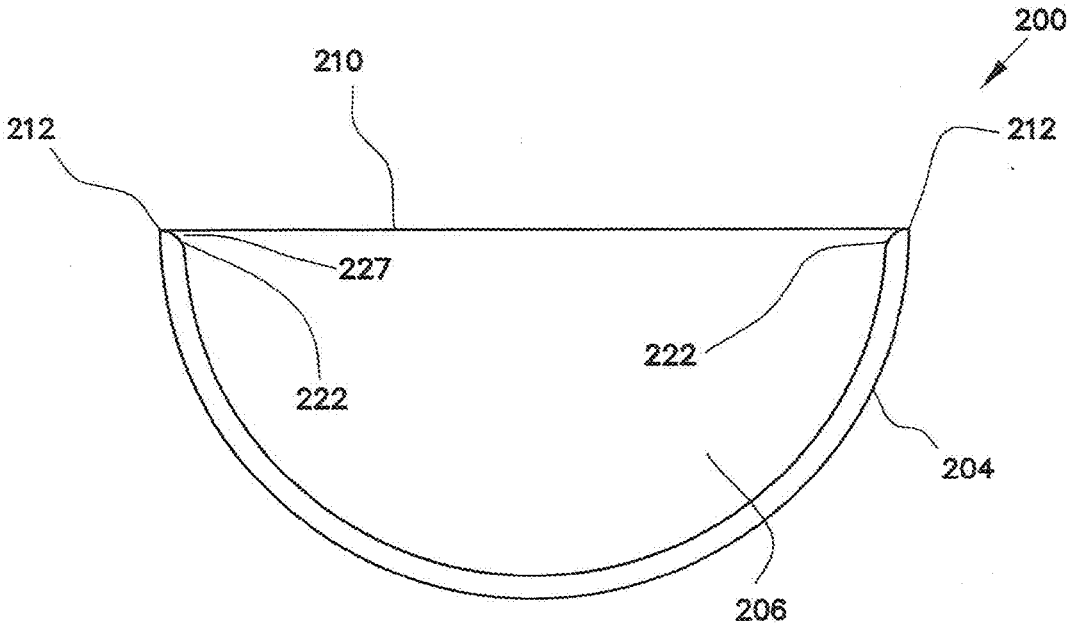
FIG. 11B is a front elevation sectional view of the second shell portion 204 of FIG. 10B, but with the second liquid 210 completely filling the second shell portion 204 in accordance with the present invention.
Figure 11C:
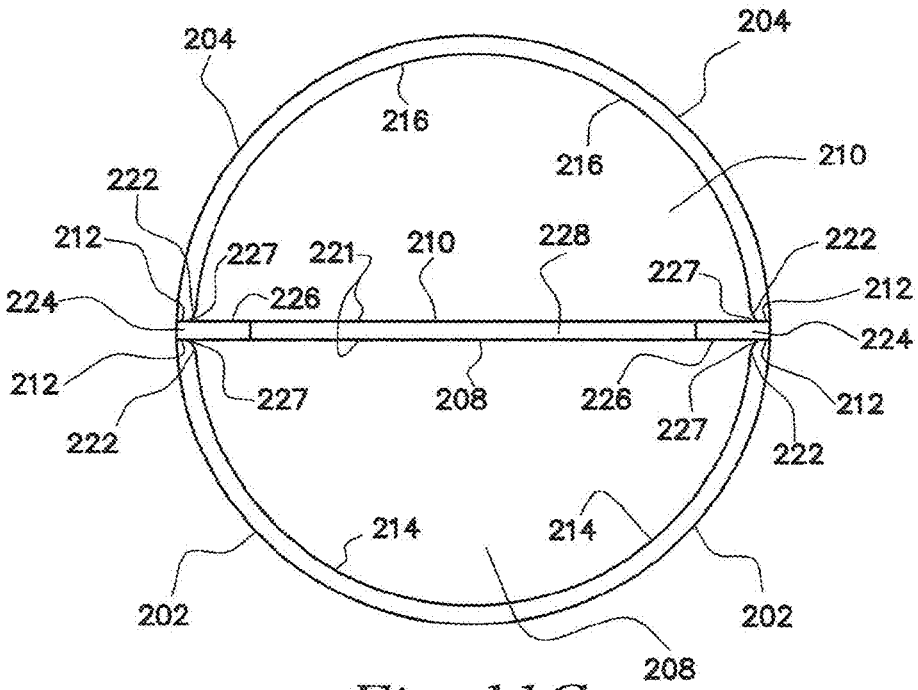
FIG. 11C is a front elevation sectional view of the second shell portion 204 of FIG. 11B disposed congruently upon the first shell portion 202, thereby forming a paintball in accordance with the present invention.
Figure 11D:
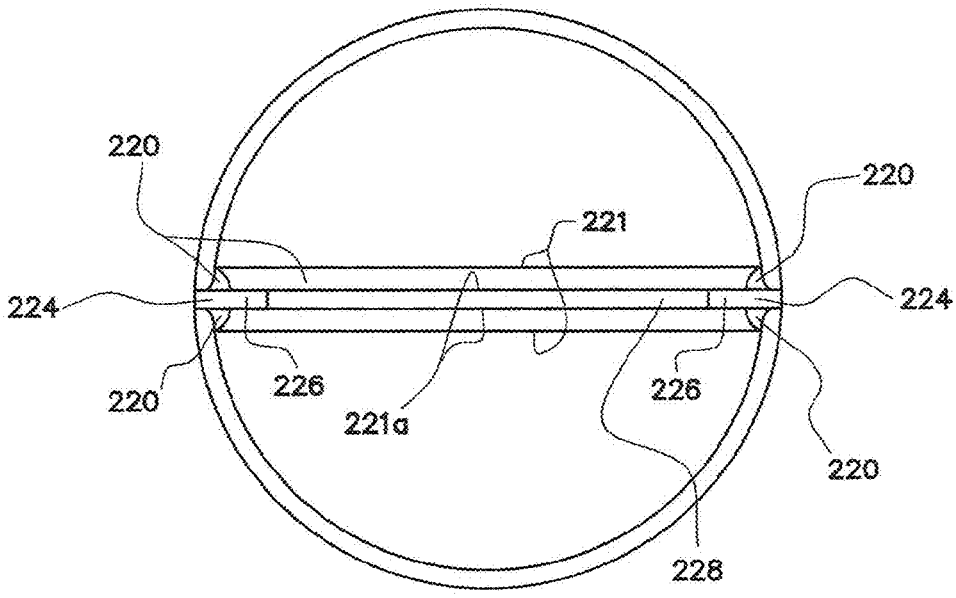
FIG. 11D is a front elevation sectional view of the paintball of FIG. 11C, but with an adhesive bead 220 added to cooperate with the annulus 224 to provide added holding strength to the joined first and second shell portions in accordance with the present invention.
Figure 11E:
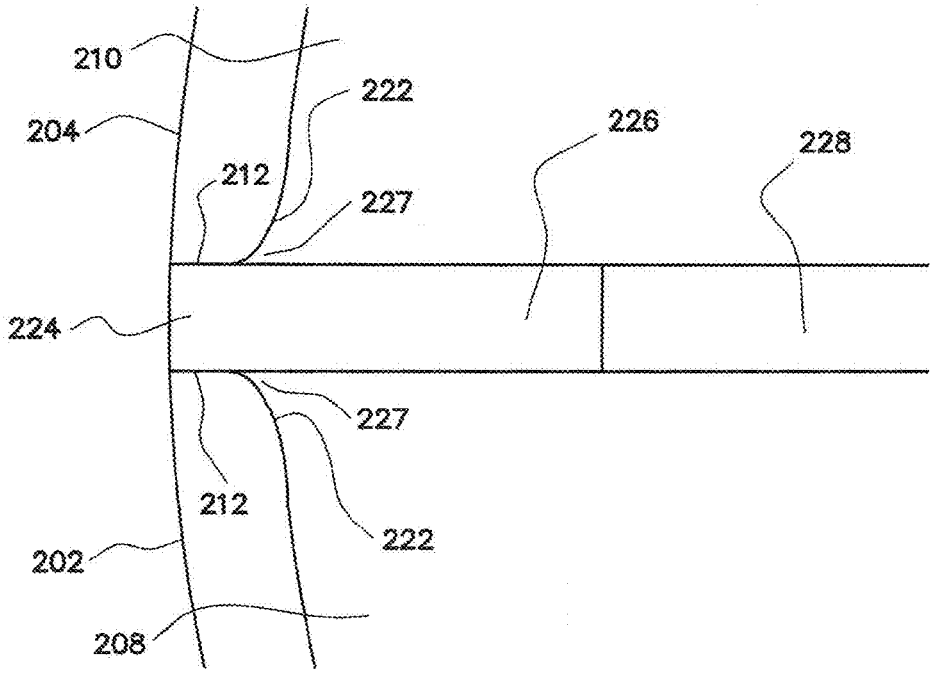
FIG. 11E is a blow-up partial view of FIG. 11C depicting the annular portions 212 of the first and second shell portions joined to the annulus 224.

11F is a blow-up partial view of FIG. 11D depicting the annular portions 212 of the first and second shell portions joined to the annulus 224 and the adhesive bead 220.

Figure 5A:
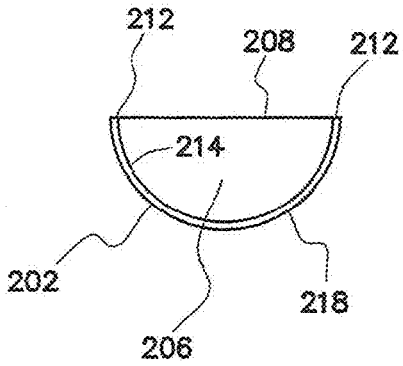
FIGS. 5A and 5B are front elevation sectional views of respective first and second shell portions that are ultimately joined together to form a paintball in accordance with the present invention.
Figure 12A:
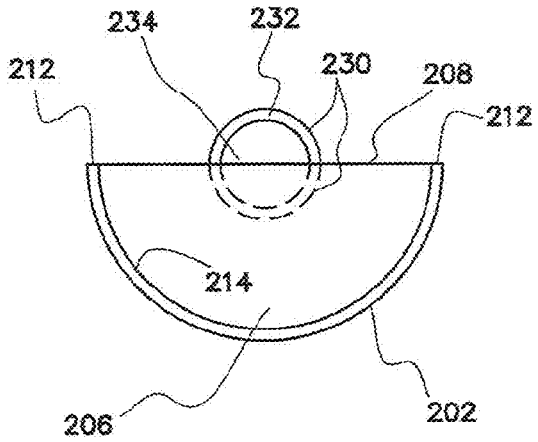

FIG. 12A is a front elevation sectional view of the first shell portion of FIG. 5A, but with an inner paintball centrally disposed in the first shell portion in accordance with the present invention.

Figure 5B:
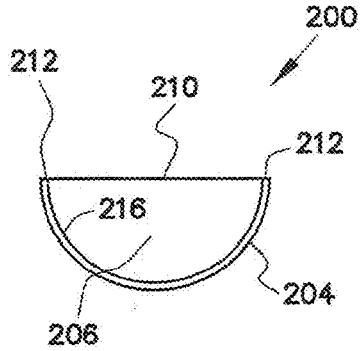
Figure 5C:
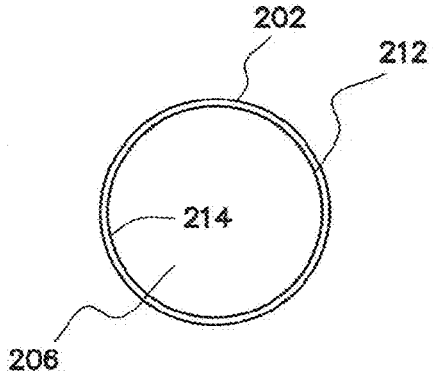
FIG. 5C is a top elevation view of the first shell portion of FIG. 5A.
Figure 5D:
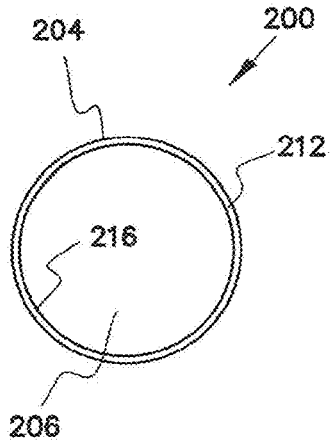
FIG. 5D is a top elevation view of the second shell portion of FIG. 5B.
Figure 12B:
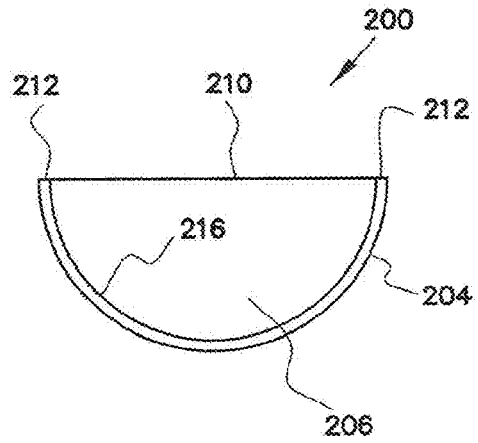

FIG. 12B is a front elevation sectional view of the second shell portion of FIG. 5B.

Figure 13A:
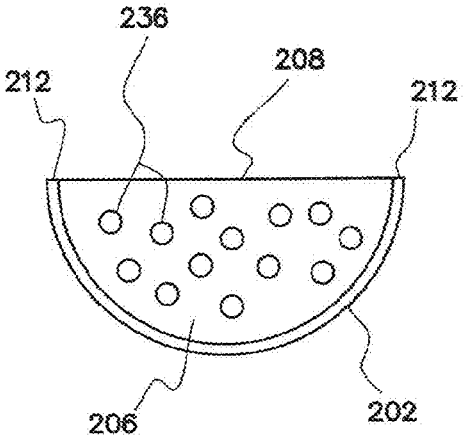

FIG. 13A is a front elevation sectional view of the first shell portion of FIG. 12A, but with a plurality of inner paintballs disposed in the first shell portion in accordance with the present invention.

Figure 13B:
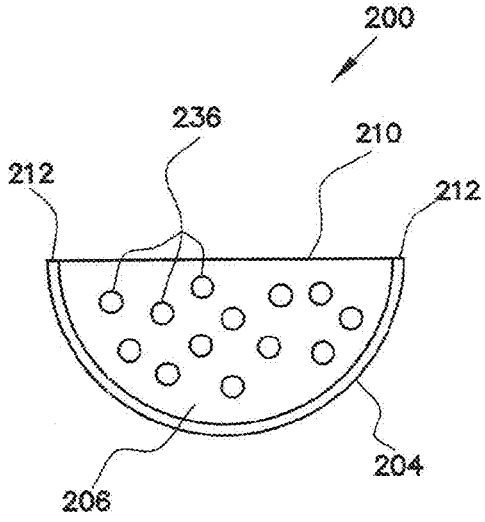

FIG. 13B is a front elevation sectional view of the second shell portion of FIG. 12B, but with a plurality of inner paintballs disposed in the second shell portion in accordance with the present invention.

Figure 14:
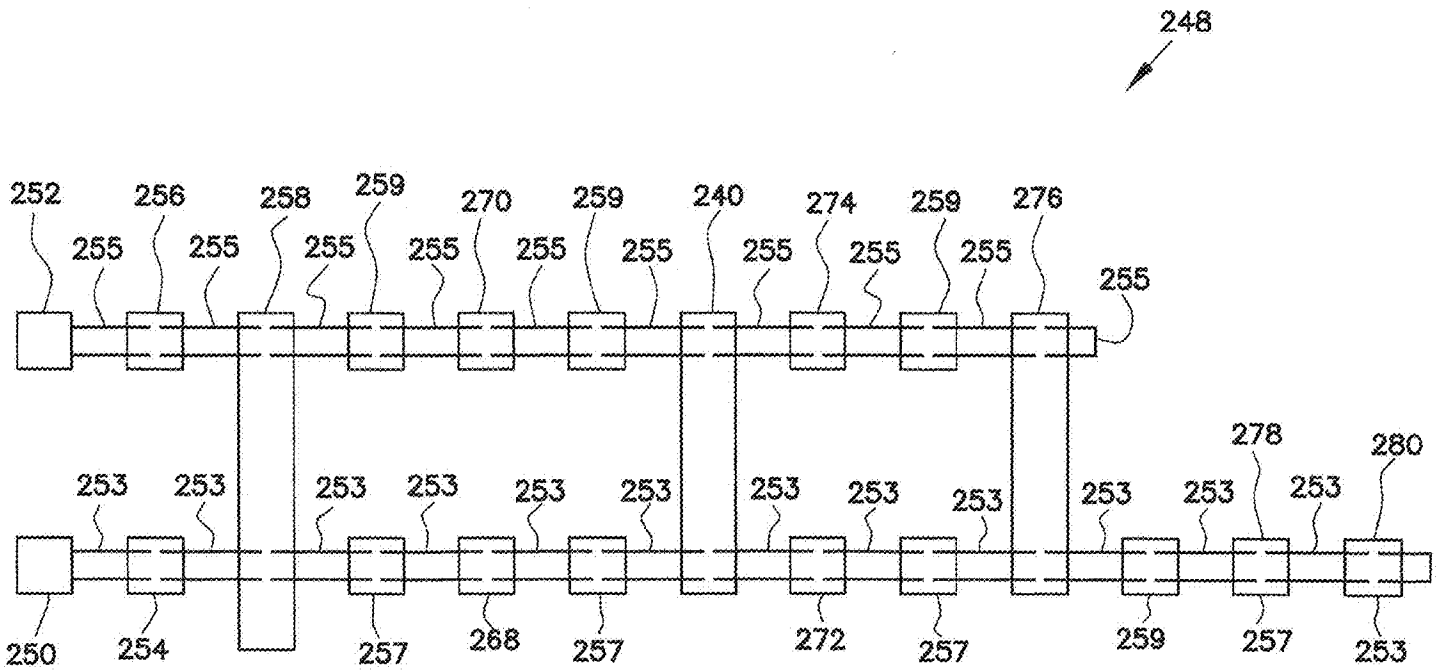

FIG. 14 is a block diagram of a system for manufacturing a plurality of paintballs simultaneously in accordance with the present invention.

Figure 15A:
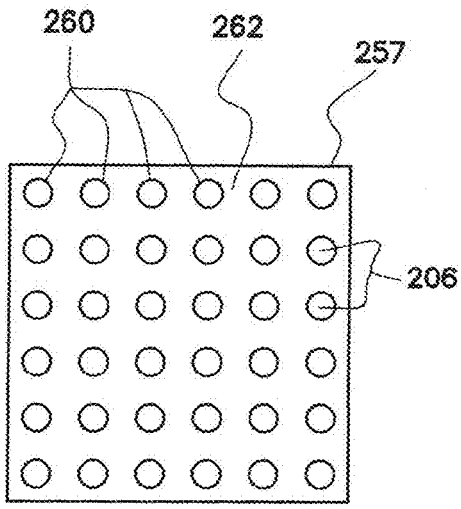

FIG. 15A is a top elevation view of a first shell sheet in accordance with the present invention.

Figure 15B:
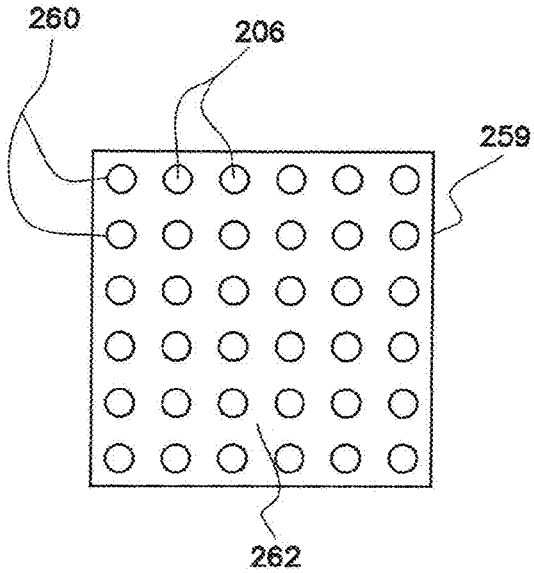

FIG. 15B is a top elevation view of a second shell sheet in accordance with the present invention.

Figure 16A:
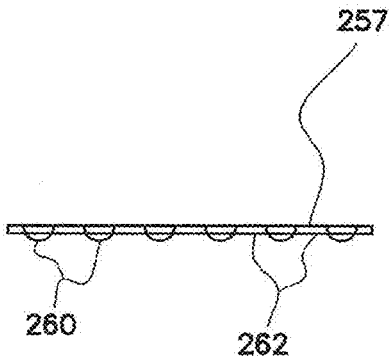

FIG. 16A is a front elevation view of the first shell sheet of FIG. 15A.

Figure 16B:
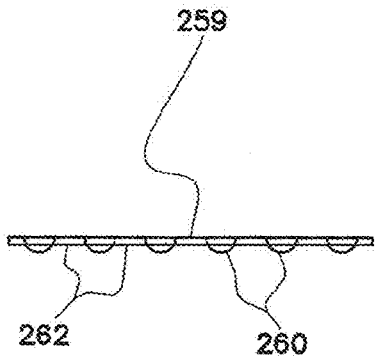

FIG. 16B is a front elevation view of the second shell sheet of FIG. 15B.

Figure 17:
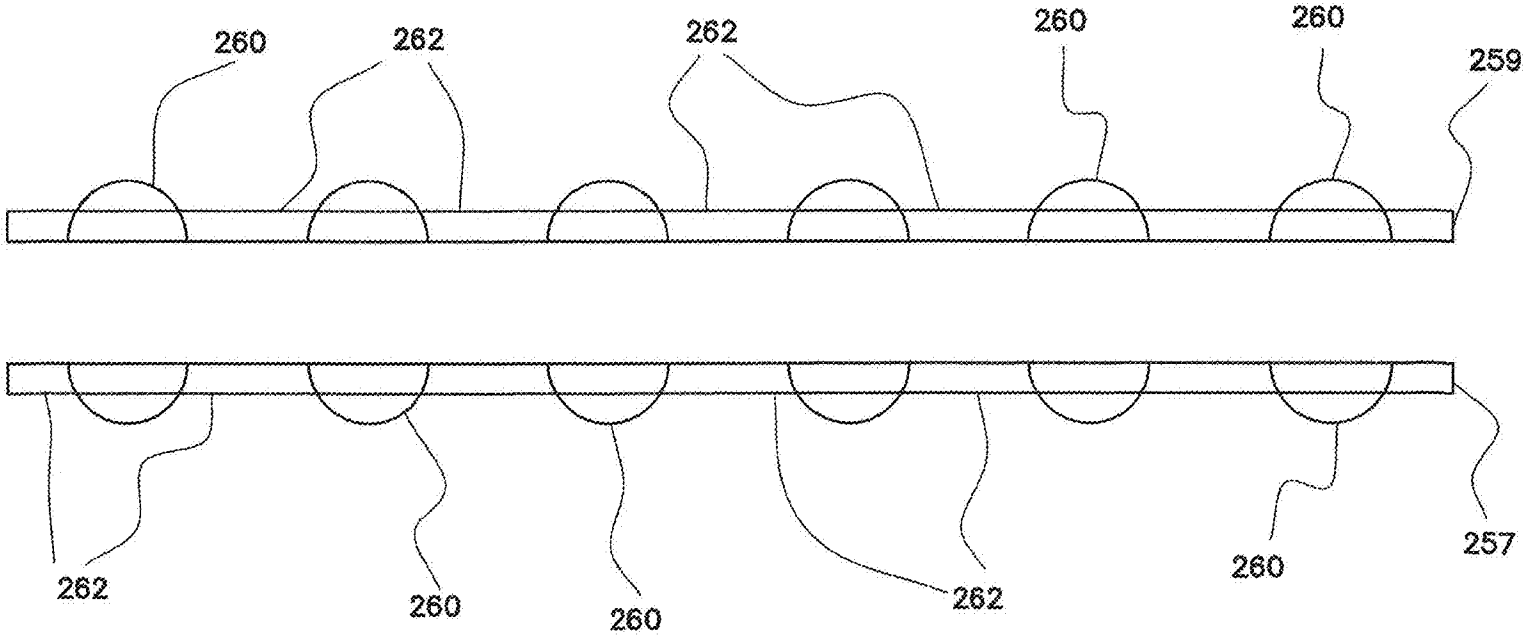

FIG. 17 is a front elevation view of the first and second shell sheets of FIGS. 16A and B, but with the second shell sheet 259 inverted and disposed congruently above the first shell sheet 257.

Figure 18:
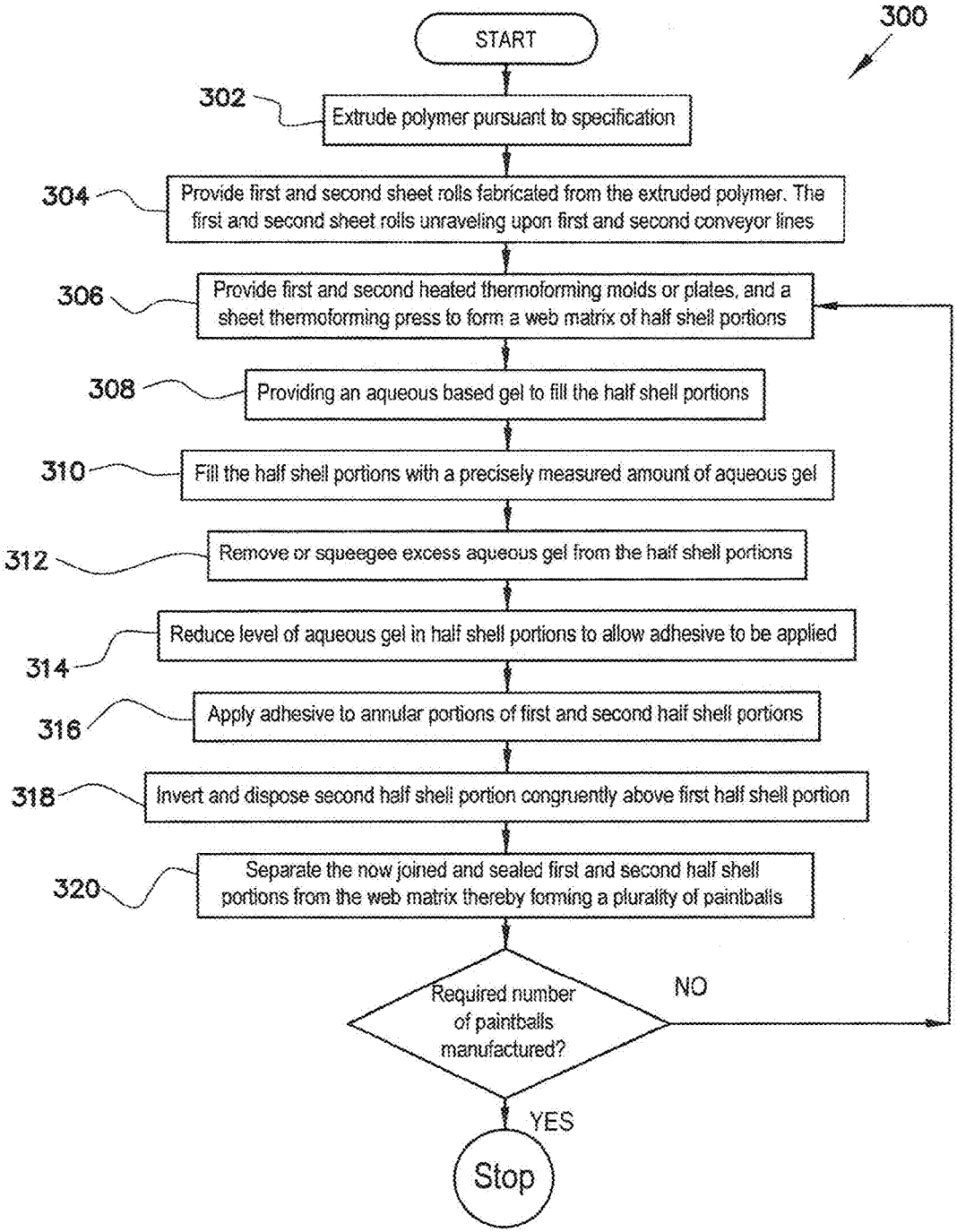

FIG. 18 is a process flow diagram of a preferred method for manufacturing a plurality of paintballs simultaneously in accordance with the present invention.

DESCRIPTION OF THE PREFERRED EMBODIMENT

Figure 1:
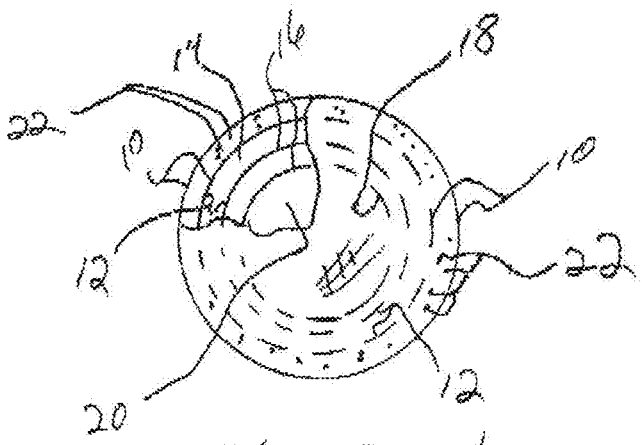
FIG. 1 is a front elevation, partial phantom-partial cutaway view of a bioluminescent paintball having light generating protein and enzyme substances in separate inner cavities in accordance with the present invention.

Referring now to the drawings and in particular to FIG. 1, a bioluminescent paintball in accordance with the present invention is denoted by numeral 8. The bioluminescent paintball 8 includes a breakable solid spherical outer shell 10 constructed of two hemispheres fused together to create an interior chamber or cavity 12 containing a first liquefied substance 14. The paintball 8 further includes an inner breakable solid spherical shell 16 disposed inside the outer shell 10 and in the first liquefied substance 14. The inner shell 16 defines a second interior cavity 18 containing a second liquefied substance 20. A phosphorescent material or glow powder 22 is disposed within the outer shell 10. A light emitting paintball requires an aqueous gel with a pH ranging from 7.0 to 8.0 or similar water based filler comprising the first liquefied substance 14. Also included in the liquefied substance 14 is a luciferase or protein, a calcium-neutralizing agent such as EDTA, and dyes, paints or colorants of white or similar bright colors. Coelenterazine or CTZ (luciferin) or similar enzyme is disbursed within the second liquefied substance 20, which is purged of air bubbles and air pockets and may contain fillers such as propylene glycol. The proteins and enzymes are disclosed in U.S. Pat. Nos. 6,232,107 and 6,436,682 belonging to Prolume Ltd. of PO Box 2746 Pinetop, Ariz. 85935 and Bruce J. Bryan of Beverly Hills, Calif. 90210.

The inner spherical shell 16 is approximately ⅔ the size of the outer shell 10. The inner macro or micro encapsulated sphere may be produced but is not limited to materials such as plastics, gelatins, waxes, or synthetic polymers. An inner sphere would be free from defects and could be manufactured in a process of seamless encapsulation. Special machines such as the Globex Mark III Capsulator are utilized in the manufacture of capsules in this manner and are manufactured by a company such as ITS Machinery Development.

The outer shell 10 may be comprised of insoluble materials such as plastics, waxes and hardeners such as carnauba, candelilla, bees, paraffin, stearic acid, synthetic polymers, polyesters, polylactic acid, starch copolymers, high molecular weight polyvinylalcohol, unstabalized polyethelyne, unstabilized polypropylene, polystyrene, and combinations thereof. The outer shell 10 may also consist mainly of gelatin, so long as an inner spherical wall 24 in contact with the first liquefied substance 14 is coated, treated, or filmed with an insoluble barrier constructed from waxes, proteins, synthetic polymers or natural polymers such as Chitosan, an amorphous polymer of deacylated chitin. This insoluble barrier allows for conventional gelatin materials to be used while encapsulating usually non-compatible materials within the gelatin shell. In this embodiment it is intended that when the paintball is projected at sufficient force that both the outer and inner shells 10 and 16 fracture and expel respective first and second liquefied substances 14 and 20 causing a mixture and subsequent chemical reaction. Luciferase catalyzes the oxidation of the Coelentrazine or Luciferin, this results in a reaction causing light and resulting in an inactive Oxyluciferin.

Luciferin and Luciferase may also be bound to a cofactor such as oxygen (O2) in order to create a single photoprotein, or a molecule, which is reactive with ions such as Calcium (Ca2++) in order to facilitate an ion exchange and chemical reaction, which produces visible light. This configuration of compounds in fact comprises the preferred embodiment of the invention.

Figure 2:
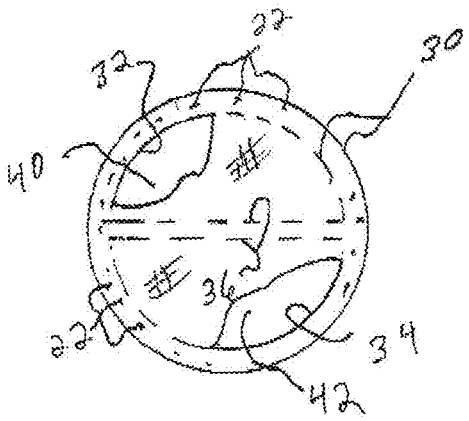
FIG. 2 is a front elevation, partial phantom-partial cutaway view of the bioluminescent paintball of FIG. 1 but with an alternative design for the inner cavities in accordance with the present invention.

Referring now to FIG. 2, an alternative embodiment 29 in accordance with the present invention is depicted. The alternative embodiment 29 includes a breakable solid spherical outer shell 30 formed from two hemispheres fused together to define first and second inner cavities 32 and 34 separated by an inner wall 36. The outer shell 30 is insoluble and may include a phosphorescent material 22 disposed within the shell 30, a first liquid substance 40 disposed in the first inner cavity 32, and a second liquid substance 42 disposed in the second inner cavity 34. Coelentrazine (Luciferin) or similar enzyme is disbursed within the first liquid substance 40, which is purged of air bubbles and air pockets. A light emitting paintball requires an aqueous material with a pH ranging from 7.0 and 8.0 disbursed within the second liquid substance 42. Also included in the second liquid substance 42 is a Luciferase or protein, and dyes, paints or colorants.

The phosphorescent material 22 glows in the dark after being exposed to a light for a period of time and said liquefied substance and subsequent dyes providing a reflective background in order to increase the brilliance and duration of the glowing phosphors. Further a light with a higher concentrate of Ultraviolet (UV) light, generally increases the potential for energy absorption on a smaller timeline, and increases overall duration and brilliance of a nighttime glow. The phosphorescent materials may be comprised of a multitude of powders loaded at up to 10% by weight into the outer spherical shell. The phosphors may consist of Aluminum, Europium, Strontium, Iridium or Boron Oxides which provide a wide array of colors including but not limited to Orange, Green, Yellow, Blue, Purple, Red, Red-Orange, Blue-Green and Aqua. Said phosphors being constructed by Hirotec, Inc. of Santa Ana, Calif. and Nichia America of Mountville, Pa.

Figure 3:
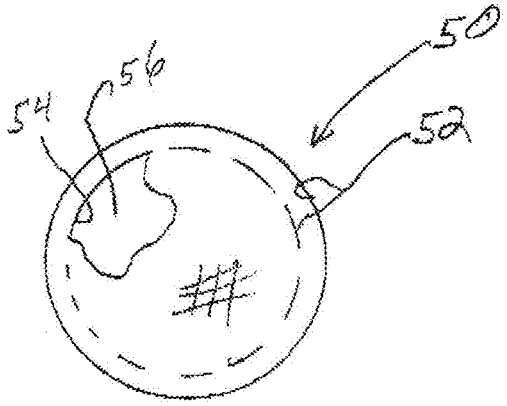
FIG. 3 is a front elevation, partial phantom-partial cutaway view of a bioluminescent paintball having one cavity with an ion reactive photoprotein substance disbursed therein in accordance with the present invention.

Referring now to FIG. 3, a third and preferred embodiment 50 in accordance with the present invention is depicted. The preferred embodiment includes a homogenous liquefied mixture 56 having ions such as Calcium (Ca2++) neutralized by a calcium neutralizing agent such as EDTA, a photoprotein (bound Luciferin and Luciferase by a cofactor such as Oxygen) a single ion reactive compound added to the liquefied substance, renders the entire mixture "reactive" in that when in contact with an ion a chemical reaction occurs which generates visible light. Thus, when the liquefied substance is expelled from a fractured paintball upon a target containing an ion, most notably calcium, the liquefied substance yields a bright visible "glow", which is satisfactory to identify a "mark" or strike on a target in low light or dark conditions.

In a preferred embodiment 50 of the present invention, a water insoluble phosphor comprised mainly of such as those manufactured by Nichia America. Phosphors can include but are not limited to the following chemical composition and product number:

Blue-green $Sr_4Al_{14}O_{25}$:Eu,Dy (Nichia product NP-2820)
Reddish-Orange $Y_2O_2S$:Eu,Mg,Ti (Nichia product NP-2850)
Green $SrAl_2O_4$:Eu,Dy (Nichia product NP-2830)

Additionally in the preferred embodiment 50 of the present invention, a photoprotein (a single reactive compound), and ion neutralizer most notably a calcium neutralizer, are disposed in the liquefied substance 56 of an inner cavity 54 created by an outer breakable solid spherical shell 52 comprised of two fused hemispheres and of which can be comprised of gelatins, plasticizers, waxes, synthetic polymers, polyesters, polylactic acid, starch copolymers, high molecular weight polyvinylalcohol, unstabalized polyethelyne, unstabilized polypropylene, polystyrene, and combinations thereof. The internal surface would come into contact with the aqueous liquefied substance but for the presence of hydrophobic barrier, which may consist of proteins, chitin, waxes, or ethylcellulose. This creates an insoluble barrier between the inner surface of the outer soluble shell and the aqueous liquefied substance. Therefore, creating a homogenous mixture that will ultimately generate visible light after said paintball fractures against a selected target.

A fourth embodiment (not depicted) in accordance with the present invention, is the introduction of a water insoluble phosphor into a water filler material which is perfectly clear and is encased in an outer shell which is also transparent or translucent. This embodiment provides an environment that contains a new water based filler material and to which a unique phosphor may be added in order to generate a tracing and marking effect. With the use of water based filler materials, a completely clear filler may be used to reduce the amount of phosphors and reduce the overall cost of the product.

The photoprotein of the preferred embodiment 50 allows for the generation of sufficient light regardless of overall impact area to effectively mark a target in low light or dark conditions. As with photo-storage materials and the use of surfactants to suspend these materials the more dispersion of an impact, the less concentration of energized phosphors and therefore less brilliance and effectiveness. In this preferred embodiment of the invention, the photoprotein is dissolved within the liquefied substance prior to encapsulation at a load ratio sufficient to render the entire liquefied substance ion reactive. This should be approximately 0.5-1% load by weight of a 3.5 g paintball.

Referring back to FIG. 3, the depicted bioluminescent paintball 50 generally comprises an outer, breakable, solid spherical shell 52 fabricated of insoluble material, or utilizes an insoluble barrier and soluble materials such as gelatin. The outer shell 52 defines an interior cavity 54 having a liquefied substance 56 disposed therein, a phosphorescent material 22 disposed within the shell 52, the phosphorescent material providing a tracer effect when the bioluminescent paintball 50 is ejected from a paintball discharge device, an ion neutralizing agent disbursed within the liquefied substance 56, an ion reactive photoprotein disbursed within the liquefied substance 56, to engage the target. The outer shell 52 may be formed of transparent, translucent or pigmented material so long as the material is constructed from solid materials such as gelatins, plastics, or synthetic or organic polymers, such as polyesters, polylactic acid, starch copolymers, high molecular weight polyvinylalcohol, unstabalized polyethelyne, unstabilized polypropylene, polystyrene, and combinations thereof, which are capable of withstanding forcible projection. The outer shell 52 must also be capable of fracturing upon engaging a participant without injuring that individual.

The liquefied substance 56 disposed within the spherical shell 52 may include but is not limited to, water, polyethylene glycols, waxes, surfactants, oils, gelatins, glycerin, and thickening agents such as fumed silica and sorbitol, but the liquefied substance 56 is composed mostly of water. The liquefied substance 56 may be dyed, opaque, or may be a translucent or transparent substance.

A phosphorescent material 22 is disposed on or within the outer spherical shell 52 for tracer effects in Ultraviolet, low light or dark conditions. The most preferred phosphors do not include materials that are known to be toxic, and do not include radioactive materials. One highly suitable insoluble phosphor is available from Nichia America Corporation of 3775 Hempland Road, Mountville, Pa. 17554. The Nichia phosphors includes the following materials:

Blue-green $Sr_4Al_{14}O_{25}$:Eu,Dy (Nichia product NP-2820)
Reddish-Orange $Y_2O_2S$:Eu,Mg,Ti (Nichia product NP-2850)
Green $SrAl_2O_4$:Eu,Dy (Nichia product NP-2830)

Another highly suitable phosphor is available under the trade name "PERMAGLOW™ Premium Glow-in-the-Dark colors" from Hirotec Inc. of 16162 Beach Blvd., Suite 306, of Huntington Beach, Calif. 92647. The PERMAGLOW product includes the following materials:

| Material | Notation | Chemical No. | TSCA No. |
|---|---|---|---|
| Aluminum Oxide | Al2O3 | 1-23 | 1344-28-1 |
| Strontium Oxide | SrO | 9-2441 | 1314-11-0 |
| Europium Oxide | Eu2O3 | 1-679 | 1308-96-9 |
| Boron Oxide | B2O3 | 9-2403 | 1303-86-2 |

The phosphorescent material 22 is capable of producing light after being charged with a light energy source for a period of time to achieve the desired tracer effect. The duration of the production of light is directly related to the time of exposure to a light source to achieve the desired duration.

Overall these new phosphorescent materials 22 contain new characteristics capable of providing the new luminescent paintball with a multitude of colors such as blue, green, blue-green, red, reddish-orange, yellow, orange, violet, pink, aqua, chartreuse and any Pantone™ colors which can be manufactured as needed.

The liquefied substance 56 includes an ion-neutralizing agent such as ethelenediaminetetraacetic acid (EDTA). This calcium-neutralizing agent establishes a stable environment for the introduction of an ion reactive protein or photoprotein into the liquefied substance 56. The EDTA is mixed within the liquefied substance 56 prior to encapsulation into the paintball 50.

After the mixture of EDTA or similar ion neutralizing agent into the liquefied substance 56, an ion reactive photoprotein similar to the enzymes in U.S. Pat. Nos. 6,436,682, 6,247,995, 6,232,107, 6,113,886, 6,152,358, 5,876,995 and made by PROLUME LTD, 163 White Mountain, Pinetop Ariz. USA, 85935, is dissolved into the liquefied substance. This photoprotein is capable of reacting with ions such as calcium or objects containing calcium and producing visible light in the chemical reaction, lasting from several seconds up to ten minutes and satisfying the necessary marking effect in a low light or dark environment.

The addition of this photoprotein produces visible light when the liquefied substance 56 disposed in an inner cavity 54 of the paintball 50 engages a target containing an ion such as calcium (Ca2++). More specifically, when the paintball 50 is forcibly ejected from a paintball gun or discharge device to ultimately engage a target, the outer spherical shell 52 of the paintball 50 ruptures, thereby allowing the inner liquefied substance 56 to engage the target and react with the calcium naturally existing upon a target to produce light. This production of light creates a marking effect on the target that lasts for a predetermined period of time and thus satisfying one vital aspect to an effective luminescent paintball.

The employment of the photoprotein allows for the possibility to exclude phosphors 22 from the liquefied substance, while relegating phosphors instead to the outer spherical shell 52. These phosphors may be used in conjunction with a water fill without the concern for dissolution and thus complete ineffectiveness. Further, when excited these phosphors produce a visible light used to generate a tracer effect necessary for the correction of firing and accurate aiming when engaging a target.

The result is a new luminescent paintball 50, which provides a necessary dual system of tracing and marking. This further enhances the possibility to develop a game or exercise program in association with the use of this new invention.

The foregoing description is for purposes of illustration only and is not intended to limit the scope of protection accorded this invention. The scope of protection is to be measured by the following claims, which should be interpreted as broadly as the inventive contribution permits.

Figure 4:
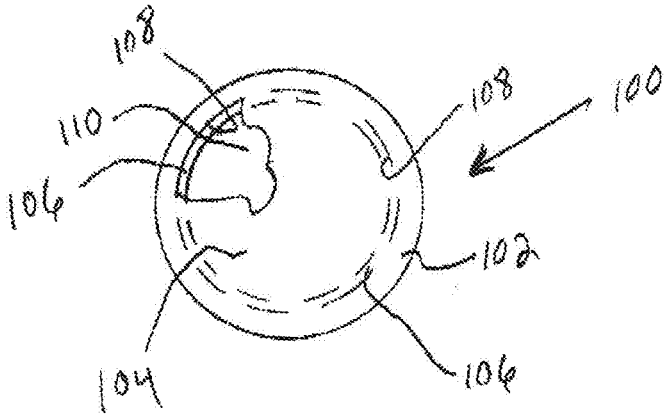
FIG. 4 is a front elevation, partial phantom-partial cutaway view of a water based paintball having a cavity with an aqueous material disbursed therein in accordance with the present invention.

Referring now to FIG. 4, a water based paintball in accordance with the present invention is depicted and denoted as numeral 100. The paintball 100 includes a shell 102 of soluble materials (usually gelatin) defining an interior cavity 104, an insoluble coating 106 disposed upon an inner surface 108 of the shell 102, and a water based or aqueous material 110 disposed and disbursed within the cavity 104 such that the aqueous material 110 engages the insoluble coating 106, thereby preventing the aqueous material 110 from dissolving the shell 102, and promoting the marking of a target via the aqueous material 110 when the paintball 100 is forcibly ejected from a paintball gun (not depicted) ultimately engaging the target causing the shell 102 to rupture and the aqueous material 110 with suspended pigments to disburse upon the target surface.

The shell 102 is fabricated from an extrusion grade biodegradable polymer, extrusion-compounded with inert processing aids and pigments, and extrusion cast into a rolled sheet of dimensions well known to those of ordinary skill in the art. Suitable polymers include, but are not limited to biodegradable polyesters, polylactic acid, starch copolymers and polymer blends, high molecular weight polyvinylalcohol, unstabilized polyethylene, unstabilized polypropylene and polystyrene, and combinations thereof. Coloring pigments may be included in the shell 102. Should the paintball be required for night paintball use, a phosphorescent material may be added to the shell 102, together with a surfactant material to promote the uniform disbursement of the phosphorescent material (or the coloring pigments) throughout the outer shell 102.

The insoluble coating 106 is only necessary when used in conjunction with a soluble outer shell 102. The insoluble coating 106 is a relatively thin layer of a hydrophobic cellulose, including but not limited to ethyl cellulose or similar polymer, an insoluble plasticizer, and fumed silica. The insoluble coating 106 is not suitable to create a projectile that is capable of withstanding projection from an air powered paintball gun. Instead, the insoluble coating 106 performs as an inner shell, which acts as a barrier between the soluble outer shell 102 and the aqueous material 110. The insoluble coating 106 prevents all interaction between the outer shell 102 and the aqueous material 110, thereby allowing the aqueous material 110 to be encapsulated in an otherwise unsuitable outer shell 102.

The aqueous material 110 includes a water content ranging between 1% and 90%, a thixtropic agent, such as Laponite RD, ranging between 1% and 5%, pigments ranging between 1% and 3%, and a neutralizing agent, such as citric acid, in an amount effective to neutralize the mixture to a ph ranging between 7.0 and 8.0, generally 2-3% by weight. The aqueous material 110 is prepared by dispersing the Laponite RD in a portion of the formula water, using a medium to high shear mixer, until a clear material forms. Pigments and ph neutralizer are mixed with the remaining water until a homogenous mixture forms. The colored mixture is then added to the stirring Laponite RD mixture and stirred until homogenous.

The water based paintball 100 is manufactured by first feeding a polymer sheet material onto a heated, horizontal vacuum thermoforming mold. The thermo forming molds contain multiple cavities, in the shape of paintball half-shells. Any caliber of paintballs may be manufactured by adjusting the thermoforming mold cavity geometries to the desired dimensions. By using heated vacuum molds and plug assistance, to ensure uniform shell wall thickness, webs of paintball half-shells are thermoformed. The shell cavities are then filled with the aqueous material 110 using precision metering nozzles so that each cavity is completely filled, level with the top of the web surface. The filling rate and shear of the nozzle is chosen so that the aqueous material 110 thins enough during injection to self-level in the cavities. The aqueous material 110 thereafter forms a gel on standing within a few seconds, and as a gel does not leak out of the half-shells. While the aqueous material 110 is in the gel state, the two filled webs are then turned, either horizontal or vertical, so that the webs oppose each other and the inside surface of the webs are heated to the sealing temperature by use of heated plates or heated air streams. The half-shells are then quickly brought together and compressed with sealing fixtures containing sealing flanges, thus sealing the two filled capsule halves together and forming the paintballs.

Other methods of heating the webs for sealing may be used such as heated molds and ultrasonic welding. Alternatively, the paintball half-shells may be sealed using any suitable adhesive material or sealing methods such as radio frequency sealing. The paintballs 100 are then removed from the webbing by cutting around the outside of the paintball 100 with heated cutting molds or mechanical cutting devices. The resulting paintballs 100 are ready for packaging without further processing.

The paintballs 100 are fabricated in sufficient quantity by preparing a compound having a predetermined biodegradable thermoplastic polymer with the desired pigments; extruding the polymer into rolled sheeting of the desired thickness generally in the range of) 0.005 inches to 0.020 inches; heating and vacuum forming the sheet with the aid of matched metal molds to form "webs" containing paintball rigid half-shells with central recesses formed in the half-shells; coating inner walls of the central recesses with an insoluble material 106, required only when using soluble material to form the outer shell 102; filling the central recesses in the half shells with a precisely measured amount of aqueous material 110, which contains a thixotropic thickener (Laponite RD) to promote the leveling and gelling of the aqueous material 110 in the half-shells; allowing the aqueous material 110 to gel; joining two half-shells with the gelled aqueous material 110 in the recesses to form a spherical paintball; sealing a seam of the two joined half-shells via heat to melt the polymer shell material, or sealing the seam via adhesives well known to those of ordinary skill in the art; and removing the formed and sealed paintballs from the webbing via "hot knives" or by a mechanical cutting system well know to those of ordinary skill in the art.

An alternative method for fabricating the paintballs 100 includes two congruent sets of molds with selected configurations (usually spherical). The molds are joined together to form multiple cavities with fill apertures to promote access of the aqueous material 110 into each cavity. After each cavity is filled with aqueous material 110, a pin is inserted through the fill aperture and into the internal cavity of the mold. After the liquid aqueous material 110 sets in the mold for a relatively short time period, a thixotropic thickener causes the aqueous material 110 to become a relatively rigid gel that grasps the pin. After the two sets of molds are horizontally disposed and separated, the aqueous gel material 110 is removed from a bottom mold via the pin, then supported by the pin to allow a coating of insoluble material 106 to sprayed upon the entire surface of the gel 110, followed by polymer coating sprayed upon or formed (via dip coating techniques) over the insoluble material 106. The pin is removed after the polymer hardens, and the resulting aperture is sealed with the same polymer. The hardened polymer forms the shell 102 of the water based paintball 100 and promotes the projection of the paintball 100 from an air powered gun. The shell 102 is capable of breaking or rupturing upon a target, whereupon, the activity or energy of the paintball 100 engaging the target causes the aqueous gel material to convert back to a substantially liquid aqueous material and flow upon and mark the target.

Referring now to FIGS. 5A-5D, an alternative paintball 200 in accordance with the present invention is depicted as separated first and second shell portions 202 and 204 or hemispheres, each shell portion 202 and 204 having an inner recess 206. The recess 206 in the first shell portion 202 is filled with a first liquid 208, and the recess 206 of the second portion 204 is filled with a viscous second liquid 210. The volumes of the first and second liquids 208 and 210 are substantially equal to the volumes of the inner recesses 206 in which the first and second liquids 208 and 210 are disposed. A suitable adhesive is required to ultimately join together the first and second shell portions 202 and 204. The adhesive must possess a viscosity that promotes gap filling and results in a complete seal between joined annular portions 212 or "rims" of the first and second shell portions 202 and 204. The adhesive is disposed upon an annular portion 212 of at least one of the first and second shell portions 202 and 204, and preferably the adhesive is disposed upon both annular portions 212 of both shell portions 202 and 204. The preferred adhesive is type Ethyl Cyanoacrylate or Loctite® 454 Prism® Surface Insensitive Instant Adhesive Gel made by Henkel Corporation.

Figure 6:
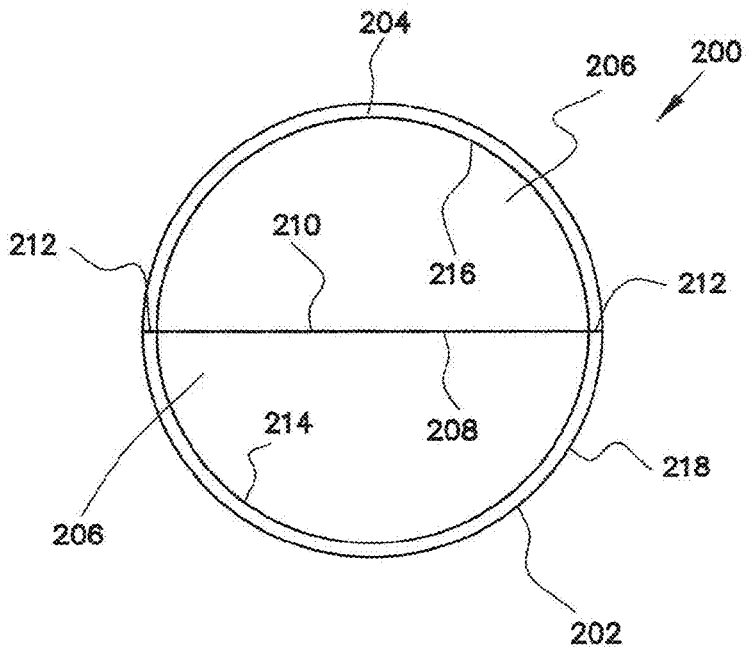
FIG. 6 is a front elevation sectional view of the first and second shell portions of FIGS. 5A and 5B joined together to form a paintball in accordance with the present invention.
Figure 7:
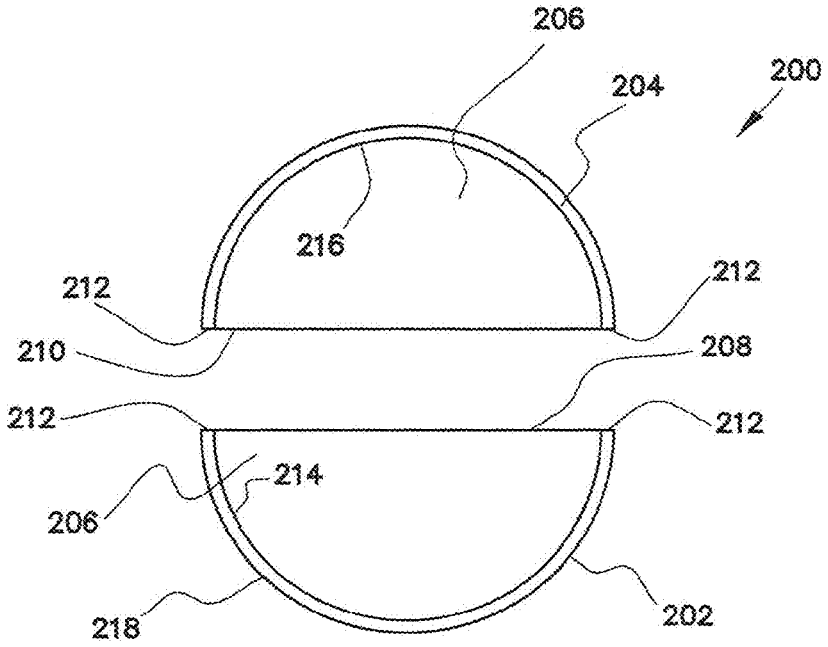
FIG. 7 is a front elevation sectional view of the first and second shell portions of FIG. 6 separated.

Referring now to FIGS. 6 and 7, the first and second shell portions 202 and 204 of FIGS. 5A-5D are joined together to form the paintball 200 with the second shell portion 204 depicted inverted and disposed upon the first shell portion 202. The first liquid 208 is non-viscous and readily flows thereby requiring the viscous second liquid 210 to be inverted to promote the ultimate joining of the second shell portion 204 to the first shell portion 202 to form the paintball 200 (see FIG. 7). The viscosity of the second liquid 210 is such that the second liquid 210 will remain inside the recess 206 of the second shell portion 204 when inverted, and after the second shell portion 204 is joined to the first shell portion 202, thereby maintaining the first liquid 208 inside the recess 206 of the first shell portion 202 after forming the paintball 200, irrespective of the orientation of the first and second liquids 208 and 210 inside the paintball 200. The required viscosity for the second liquid 210 is achieved by a rheology modifier or thixotropic thickener such as Laponite RD or Carbopol EZ-3 made by Noveon Corporation, to thicken the water based liquid, thereby increasing the viscosity of the second liquid 210 to maintain the position of the second liquid 210 inside the second shell portion 204 when the second shell portion 204 is inverted above the first shell portion 202.

The first liquid 208 may be a water based fill requiring the first shell portion 202 material to be insoluble in water (a polylactic acid material or "PLA" for example), or if the first shell portion 202 is water soluble, then a hydrophobic barrier must be applied to the inner spherical wall 214 that forms the inner recess 206 of the first shell portion 202. Further, the first liquid 208 may also include a rheology modifier or thixotropic thickener such as Laponite RD or Carbopol EZ-3 to thicken the water or water based liquid, thereby increasing the viscosity of the first liquid 208 to cooperate with the viscous second liquid 210 to further modify the characteristics of the paintball 200.

The first and second liquids 208 and 210 may be modified to include a myriad of features. The first liquid 208 can include a luminescent material, a photo protein material, a pigment or color different from the color of the second liquid 210, a plurality of viscous liquids each having a different color, a plurality of viscous liquids each having a different color and arranged in a patterned configuration, and/or an evaporating liquid that promotes a mark upon a target of varying configurations. A predetermined quantity of thixotropic agent must be added to a predetermined water or liquid portion of the first liquid 208 to increase the viscosity to a predetermined specification in order to achieve necessary coefficient of friction between the shell portion and the first liquid 208 to cause the first liquid 208 to remain in the first shell portion 202 when inverted or otherwise orientated for joining the two shell portions. The ultimate goal is to fabricate a paintball that includes an inner liquid having a relatively high viscosity during fabrication to reduce fabrication costs, and a relatively low viscosity, due to the shear thinning characteristics of the thixotropic agent, so that when the paintball impacts a target the flow of the inner liquid upon the target correspondingly increases the area of a mark upon the target.

The second liquid 210 may be a water based fill requiring the second shell portion 204 material to be insoluble in water, or if the second shell portion 204 is water soluble, then a hydrophobic barrier must be applied to the inner spherical wall 216 that forms the inner recess 206 of the second shell portion 204. Further, the second liquid 210 may include luminescent material, a photo protein material, a plurality of viscous liquids each having a different color, and/or a plurality of viscous liquids each having a different color and arranged in a patterned configuration. The second liquid 210 may include a luminescent material to generate light that ultimately reflects off the first liquid 208, thereby increasing the light generated by a paintball while in flight, and to increase the light generated by a mark imparted upon a target after the paintball forcibly engages the target and fractures.

The first shell portion 202 may include a luminescent material secured to the inner spherical wall 214 or secured to an outer spherical wall 218, or disposed within the shell portion 202, or any combination thereof. Further, the material of fabrication for the first shell portion 202 may be different than the material used to fabricate the second shell portion 204. For example, the first shell portion 202 may be fabricated from PLA and the second shell portion 204 fabricated from Polystyrene, or the first shell portion 202 could be fabricated from a water soluble material, while the second shell portion 204 is fabricated from a water insoluble material.

Figure 8A:
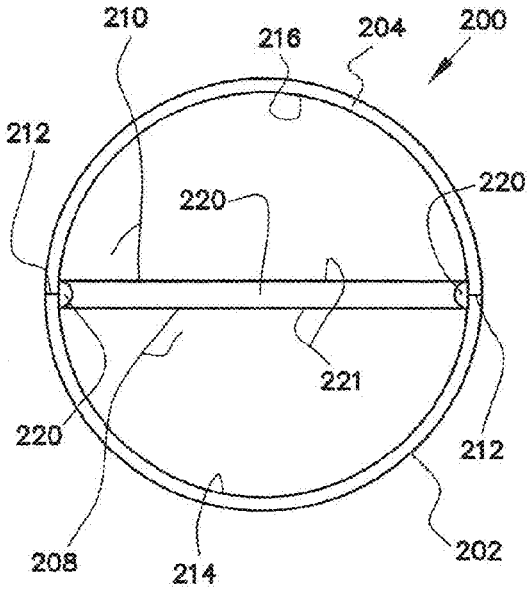
FIG. 8A is a front elevation sectional view of the first and second shell portions of FIG. 6, but with an adhesive bead 220 and an air gap 221 added in accordance with the present invention.
Figure 8B:
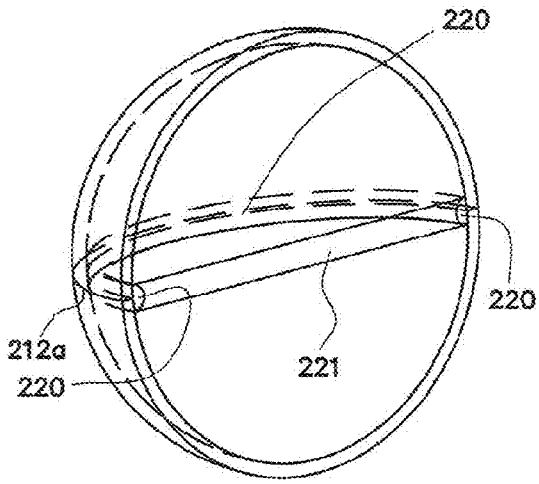
FIG. 8B is a perspective view of FIG. 8A depicting the adhesive bead 220 extending circumferentially about inner walls of the first and second shell portions, and depicting the air gap 221 separating the first and second liquids 208 and 210 in cooperation with the adhesive bead 220.
Figure 10A:
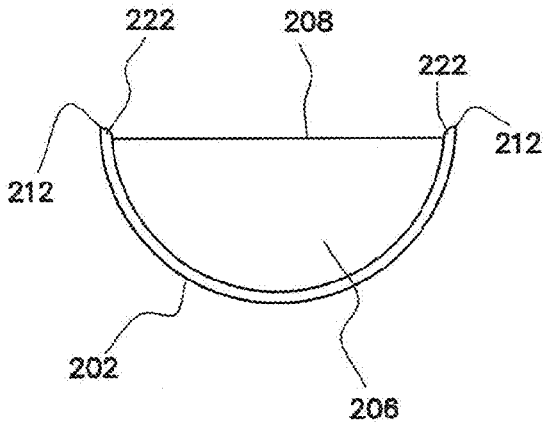
FIG. 10A is a front elevation sectional view of the first shell portion 202 of FIG. 9C, but with the adhesive bead 220 removed and the annular portion 212 including a slopping inner edge 222 with an arcuate configuration.
Figure 10B:
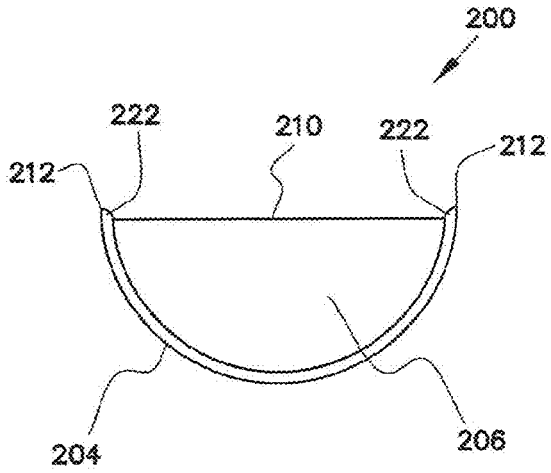
FIG. 10B is a front elevation sectional view of the second shell portion 204 of FIG. 9C, but with the annular portion 212 including a slopping inner edge 222 with an arcuate configuration.
Figure 10C:
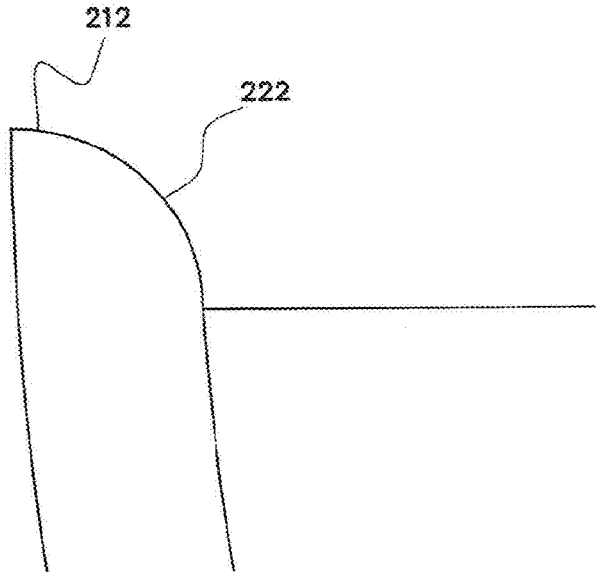
FIG. 10C is a blow-up partial view of the annular portion 212 of the first and second shell portions 202 and 204, including the slopping inner edge 222 with the arcuate configuration.
Figure 10D:
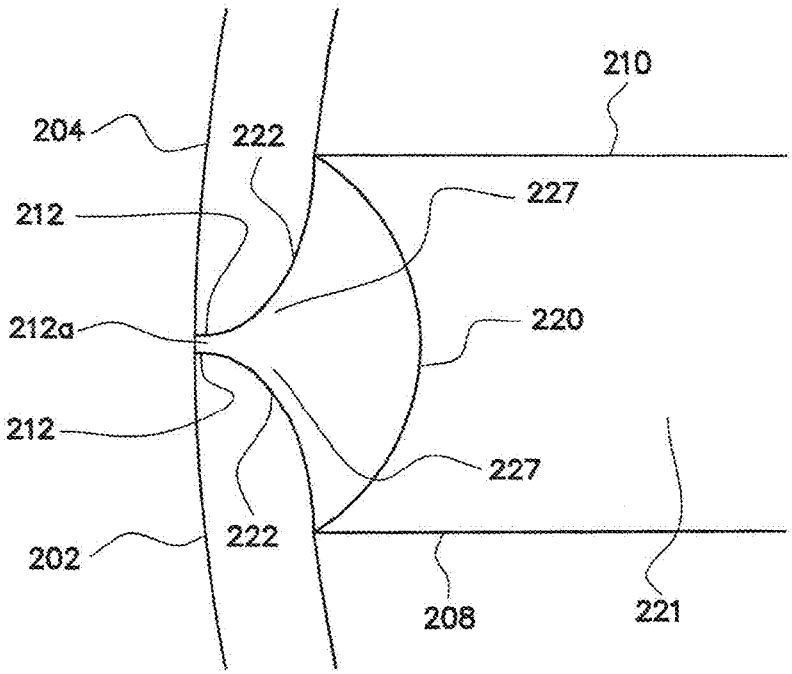
FIG. 10D is a blow-up partial view of the first and second shell portions of FIGS. 8A and 8B, the annular adhesive bead 220 and the air gap 221 in accordance with the present invention.

Referring now to FIGS. 8A-8D, 9A-9C, 10A-10D, 11A-11F the first and second shell portions 202 and 204 are shown joined together (FIGS. 8A and 8B) via the preferred adhesive between the annular portions 212, and a relatively small annular bead 220 of the preferred adhesive is depicted disposed continuously about portions of the inner spherical walls 214 and 216 of the first and second shell portions 202 and 204. The preferred adhesive between the shell portions 202 and 204 sometimes fails due to temperatures or paintball discharge forces exceeding adhesive specifications. To ensure sufficient adhesive bonding between the first and second shell portions 202 and 204, the adhesive bead 220 is added by disposing a first liquid 208 volume in the first shell portion 202 inner recess 206, the first liquid 208 volume being relatively smaller than the volume of the inner recess 206 in the first shell portion 202 (see FIG. 10A); and by disposing a second liquid 210 volume in the second shell portion 204 inner recess 206, the second viscous liquid 210 volume being relatively smaller than the volume of the inner recess 206 in the second shell portion 204 (see FIG. 10B). The recessing, or intentional reduction in first and second liquid 208 and 210 volumes results in the air gap 221 that prevents the first and second liquids 208 and 210 from compressing the adhesive bead 220 and weakening the holding force of the bead 220 upon the inner spherical walls 214 and 216 of the first and second shell portions 202 and 204. The preferred adhesive is then disposed upon the annular portions 212 of the first and second shell portions 202 and 204 such that a relatively small amount of adhesive flows over a downward sloping inner edge 222 of both the first and second shell portions 202 and 204 (see FIG. 10C), until engaging a respective surface of the first and second liquids 208 and 210.

The slopping inner edge 222 is formed from normal manufacturing techniques that provide the first and second shell portions 202 and 204. After the first and second liquids 208 and 210 are disposed in corresponding first and second shell portions 202 and 204, and after the adhesive is disposed upon the annular portions 212 of the shell portions 202 and 204, the second shell portion 204 is inverted and set upon the first shell portion 204 such that annular portions 212 are congruently joined via the adhesives on the slopping inner edges 222 of the shell portions 202 and 204 combining and "setting-up" to form an adhesive bead 220 in an air gap 221 formed via the separated first and second liquids 208 and 210 (see FIG. 10D). The adhesives on the annular portions 212 when joined form an adhesive seam 212*a* that "plugs" the gap formed via diverging slopping inner edges 222 when the first and second shell portions 202 and 204 are joined together. The adhesive seam 212*a* cooperates with the annular adhesive bead 220 to increase the grasping force bonding the second shell portion 204 to the first shell portion 202, resulting in a paintball 200 capable of withstanding field conditions that exceed the joining force provided by the adhesive only (without the bead 220) upon the annular portions 212 of the shell portions 202 and 204. Thus, the level of the first and second liquids 208 and 210 cooperate with the quantity of the adhesive applied to the annular portions 212 to establish the relative size of the adhesive bead 220 and the corresponding bonding strength applied to the first and second shell portions 202 and 204. The quantities of liquid level and adhesive will be determined from the specifications provided by the ultimate user of the paintball. Smaller volumes of the first and second liquids 208 and 210 result in a larger air gap 221 between the first and second liquids 208 and 210, and a relatively larger adhesive bead 221 (with relatively larger bonding capability) after the first and second shell portions 202 and 204 are joined together. Larger volumes of the first and second liquids 208 and 210 result in a smaller air gap 221 between the first and second liquids 208 and 210, and a relatively smaller adhesive bead 221 (with less bonding capability) after the first and second shell portions 202 and 204 are joined together. Irrespective of the selected quantity of the first and second liquids 208 and 210, a viscosity for the liquids must be selected that results in an air gap 221 that allows the adhesive to flow inward toward the shell recesses 206, the adhesive ultimately flowing upon the annular portions 212 and the sloping inner edges 222 to ultimately form an annular adhesive bead 220 upon the inner spherical walls 214 and 216 of the joined first and second shell portions 202 and 204 at the seam 212*a*, thereby facilitating the joining of the shell portions 202 and 204 to form a paintball 200 having no exterior "flange" integrally joined to the paintball 200 at the seam 212*a*.

Figure 8C:
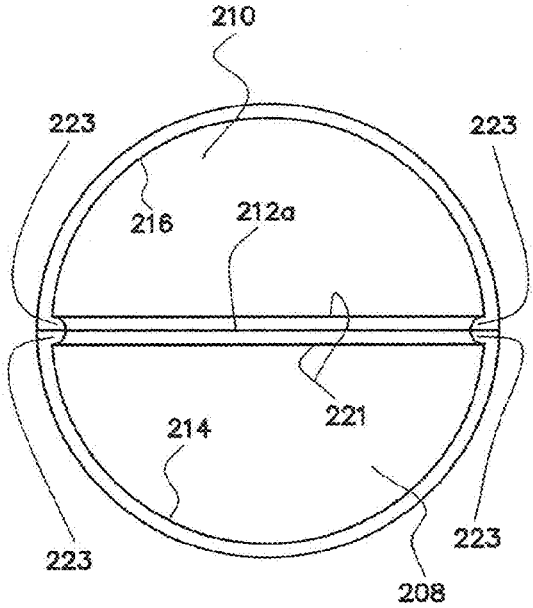
FIG. 8C is a front elevation sectional view of the first and second shell portions of FIG. 6, but with a heat seal bulge 223 and an air gap 221 added in accordance with the present invention.
Figure 8D:
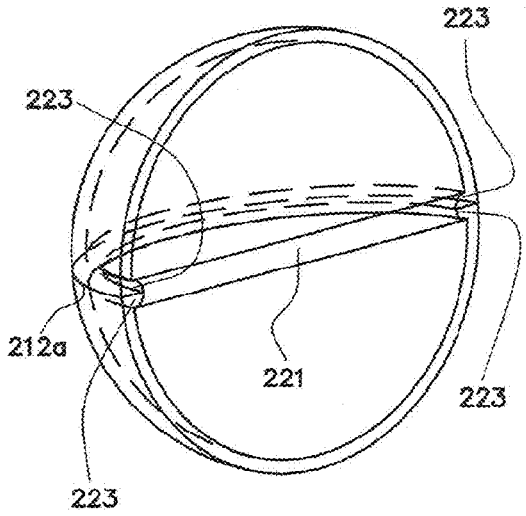
FIG. 8D is a perspective view of FIG. 8C depicting the heat seal bulge 223 extending circumferentially about inner walls of the first and second shell portions, and depicting the air gap 221 separating the first and second liquids 208 and 210 in cooperation with the heat seal bulge 223.
Figure 9A:
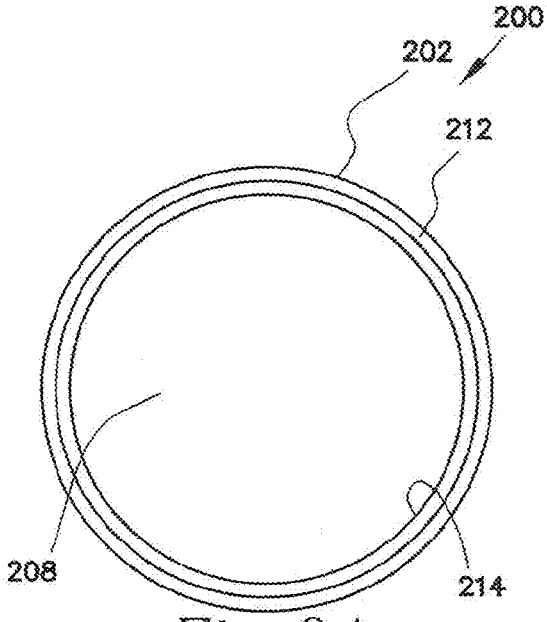
FIG. 9A is a top elevation view of the first shell portion 202 of FIG. 8A, depicting the first liquid 208 quantity reduced in volume such that the liquid surface is below the annular portion 212, thereby exposing the inner spherical wall 214.
Figure 9B:
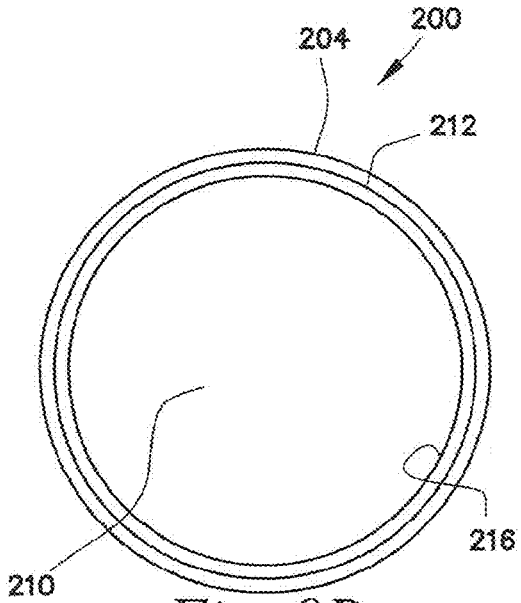
FIG. 9B is a bottom elevation view of the second shell portion 204 of FIG. 8A, depicting the second liquid 210 quantity reduced in volume such that the liquid surface is below the annular portion 212, thereby exposing the inner spherical wall 216.
Figure 9C:
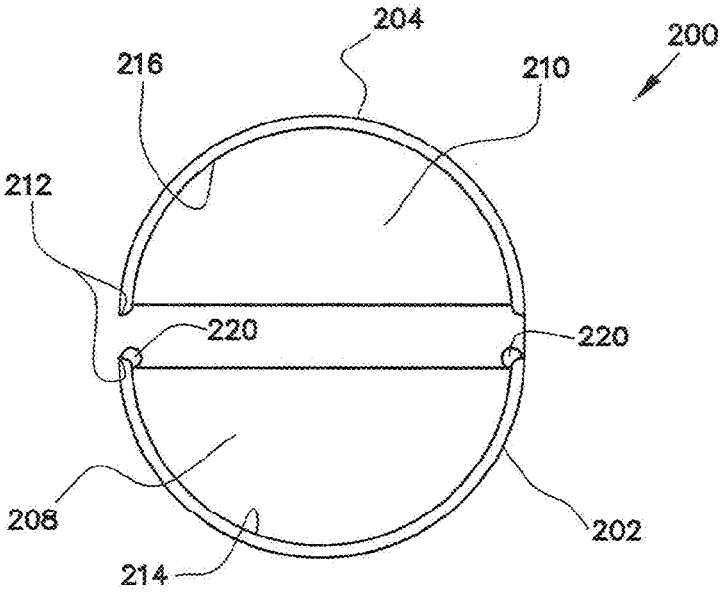
FIG. 9C is a front elevation sectional view of the second shell portion disposed congruently above and separated from the first shell portion with an adhesive bead 220 depicted upon the annular portion 212 of the first shell portion 202.

Referring to FIGS. 8C and 8D, as an alternate method of joining the two shell halves 202 and 204, a heat sealing system may be employed instead of an adhesive. The aqueous fill of the present invention provides substantial flexibility with regard to the joining means. In particular, the adhesion force and flow properties of the thixotropic gel filler ensure that it does not vacate, displace, or otherwise flow from the cavity it is injected into during production. Moreover the methods for recessing the fill within those cavities, in a preferred range of 0.001"-0.020" as previously described, ensures that the fill is vacant from the interfacing surface areas at the seam and thus does not interfere with the joining means employed for the two shell halves.

Therefore, another alternate method for producing a paintball 200 of the present invention is to employ heat to cause the first and second shell portions 202 and 204 to flow together at the annular portions 212 to create a bond and a sufficient seal. The recesses 206 of the first and second shell portions 202 and 204 are filled with respective first and second liquids 208 and 210, then the excess liquid is removed from both shell portions. The liquid fillers 208 and 210 in the recesses 206 are then caused to level or smooth by means of vibration, or by means of evaporation of moisture until the volume of the liquids is sufficiently reduced. The two shell halves 202 and 204 with recessed first and second liquid 208 and 210 volumes, are then brought together to oppose each other such that when the interfacing surfaces come into contact, a single inner chamber is formed with the first and second liquids 208 and 210 remaining in respective recesses 206, resulting in an air gap 221 separating the first and second liquids 208 and 210. The lateral dimension of the air gap 221 corresponding to the distance separating the first and second liquids 208 and 210, while the radial distance of the air gap 221 extends to the inner spherical walls 214 and 216 of the first and second shell portions 202 and 204.

This air gap 221 ensures that the first and second liquids 208 and 210 are not in the interfacing area, which is significant in a heat seal process since the fill of the present invention is primarily water, and water acts as a heat sink. As a heat sink, the filler in the chamber acts to dissipate heat that is applied to the annular portion 212 of each shell half 202 and 204. Thus, the paintball 200 surface area of the annular portion or wall 212 has an adjacent air gap and correspondingly, has no heat sink available to diffuse heat. This allows the shell material at the seam 212*a*, formed by the joining of the first and second shell portions 202 and 204 at the annular portion 212, to melt and flow together at a lower temperature than at any other portion of the outer shell. This prevents damage or surface defects to the joined first and second shell portions 202 and 204 as the first and second liquids 208 and 210 inside diffuse heat and increase the melt temperature of the first and second shell portions 202 and 204 that physically engage corresponding first and second liquids 208 and 210.

In this method the polymer at the interfacing surfaces areas is heated, melted, and directed inward such that a complete and sufficient bond is created for the paintball 200 to survive projection from a paintball discharge device. It also creates a relatively small bead of material 223 on the inner spherical walls 214 and 216 of the paintball 200 at the seam 212*a*. This bead 223 is a combination of polymer from each shell half 202 and 204, and maintains a position within the air gap 221 between the recessed first and second liquids 208 and 210. The bead 223 provides added holding force to prevent the shell halves 202 and 204 from separating when the paintball 200 is discharged from a paintball discharge device.

Referring now to FIGS. 11A-11C and 11E, an alternative technique is depicted for joining the first and second shell portions 202 and 204 together. Instead of reducing the volumes of the first and second liquids 208 and 210, and adding an adhesive bead; an annulus 224 or gasket is provided together with first and second liquid 208 and 210 volumes that are substantially equal to the volume of the recesses 206 receiving the liquids 208 and 210. The annulus 224 may be fabricated from a myriad of materials including the insoluble materials that form the first and second shell portions 202 and 204. The annulus 224 includes an outer radial dimension equal to the outer radial dimension of the annular portions 212 of the first and second shell portions 202 and 204, thereby providing a paintball without exterior perturbations. The annulus 224 includes an inner radial dimension relatively smaller than the inner radial dimension of the annular portions 212, thereby providing an inner perturbation 226 that receives excess adhesive that "fills-in" the gaps 227 caused by the sloping inner edges 222 of the annular portions 212, and increases the binding force between the annulus 224 and the annular portions 212 of the first and second shell portions 202 and 204. The annulus 224 is substantially "thin" with an axial dimension that maintains the spherical configuration of the paintball 200 formed from the first and second shell portions 202 and 204. The annulus 224 includes a central aperture 228 that promotes the fragmentation of the paintball upon striking a target. The aperture 228 also provides a small air gap 221*a* that may be filled with a third liquid with a color different from the first and second liquids 208 and 210, the third color being centered in the marking area of the paint pattern resulting from the paintball 200 striking a target.

An alternative to the annulus 224 in FIGS. 11A-11C, and 11E when increased binding force is required to hold the first and second shell portions 202 and 204 together, is to dispose an adhesive accelerant, upon the annular portions 212 of the first and second shell portions 202 and 204, and also upon surface portions of the first and second liquid 208 and 210 volumes in the recesses 206 of the first and second shell portions 202 and 204. The volumes of the first and second liquids are substantially equal to the volumes of the recesses 206 (see FIG. 11B). The adhesive accelerant forms a film having an outer radial dimension substantially equal to the outer radial dimension of the annular portions 212 of the first and second shell portions 202 and 204, the film having an inner radial dimension relatively smaller than the inner radial dimension of the annular portions 212. After disposing the adhesive accelerant upon the first and second shell portions 202 and 204, an added amount of the preferred adhesive is disposed upon the adhesive accelerant on the annular portions 212 only. The second shell portion 204 is then placed upon the first shell portion 202 causing the added adhesive, which is a gel material, to be "squeezed" from the joined shell portions and onto the adhesive accelerant inside the joined shells in the recesses 206. The accelerant causes the preferred adhesive to quickly "cure" or "set-up" which joins annular portions 212 of the first and second shell portions 202 and 204, and causes the squeezed gel adhesive to "fill-in" the void caused by the diverging sloping inner edge 222 of the annular portions 212 and to engage portions of the inner spherical walls 214 and 216 of the first and second shell portions 202 and 204 adjacent to the annular portions 212, thereby increasing the binding force holding the first and second shell portions 202 and 204 together.

Figure 11F:
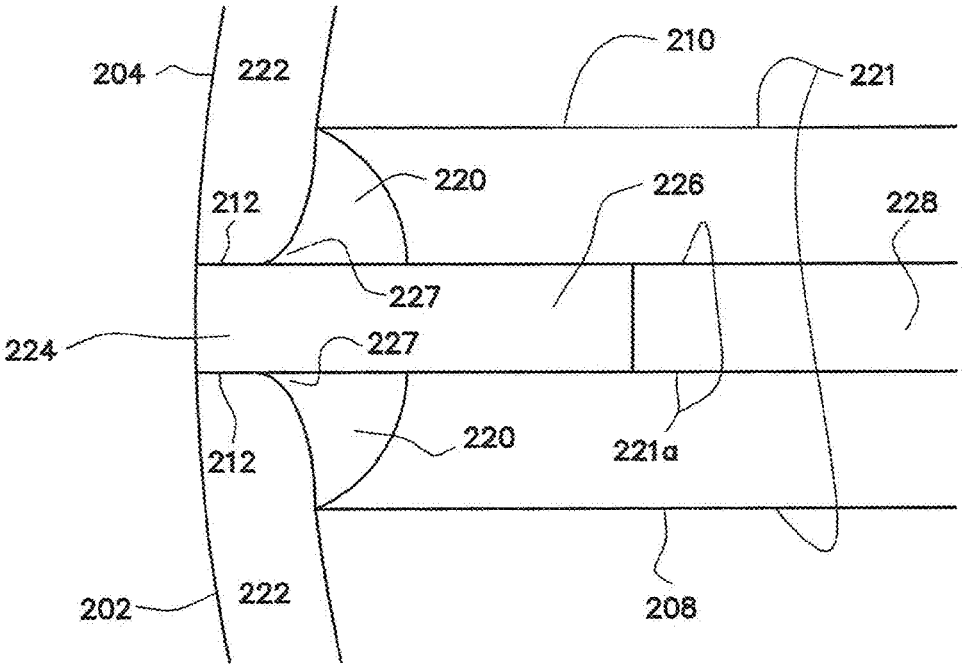

Referring now to FIGS. 11D and 11F, an alternative to only the annulus 224 in FIGS. 11A-11C, and 11E, is to include both an annulus 224 and an annular adhesive bead 220 with a cooperating air gap 221. An occasion can arise where a paintball is subject to relatively large forces during ejection from a high pressured "paintball gun." These large ejection forces can cause paintballs to rupture while in the gun. Including both the annulus 224 and the adhesive bead 220 increases the surface area that receives the adhesive thereupon, and correspondingly increases the holding force that maintains the first and second shell portions 202 and 204 together. Obviously, the amount of the first and second liquids 208 and 210 disposed in respective shell portions is reduced due to the relatively larger lateral dimension of the air gap 221 and the annulus 224 extending through a midpoint region of the air gap 221. The trade-off for the stronger binding force of the increased adhesive area is a reduced quantity of first and second liquids 208 and 210, resulting in a smaller mark upon a target struck by this more durable paintball 200.

Any paintball fabricated via the aforementioned details may include sealing means on the outer surface of the joined first and second shell portions 202 and 204 to prevent water vapor from escaping from the first and second shell portions 202 and 204, and to increase the binding strength that holds the first and second shell portions 202 and 204 together to form a paintball that meets user specifications for extreme outdoor conditions or "projection" force. Additional alternative sealing means include but are not limited to heat sealing, ultra sonic welding, alternative adhesives including two part epoxies, hot melts, or ultra-violet cure, radio frequency welding, hot air/wedge welding, solvent welding, spin welding, or laser welding.

Referring now to FIGS. 12A and 12B, an inner paintball 230 is disposed in a first viscous first liquid 208 having a first color in the inner recess 206 of a first shell portion 202. A second viscous liquid 210 having a second color is disposed in an inner recess 206 in a second shell portion 204. The first viscous liquid 208 enables the first shell portion 202 to be orientated in any position proximate to the second shell portion 204 to promote the joining of the first shell portion 202 to the second shell portion. The second viscous liquid 210 enables the second shell portion 204 to be orientated in any position proximate to the second shell portion 204 to promote the joining of the second shell portion 204 to the first shell portion 202. The inner paintball 230 includes an outer shell 232 and an inner liquid 234 having a third color. The preferred adhesive is disposed upon the annular portions 212 of the first and/or second shell portion 202 and 204. The level of the first liquid 208 in the recess 206 of the first shell portion 202 is substantially flush with the annular portion 212, while the inner paintball 230 is substantially half submerged in the first liquid. A predetermined amount of the second liquid 210 is disposed into the recess 206 of the second shell portion 204 that allows the first and second shell portions 202 and 204 to be joined together such that no liquid is forced from either shell portion 202 and 204, and such that no air gaps are present in either recess 206 of the shell portions 202 and 204. The first and second shell portions 202 and 204 are ultimately joined together via the preferred adhesive such that the inner paintball 230 is substantially centered within the joined shell portions 202 and 204, whereby an outer paintball is fabricated about an inner paintball 230 such that the position of the inner paintball 230 is substantially maintained via the relatively viscous first and second liquids 208 and 210 when the outer paintball is discharged from a paintball discharge device to ultimately strike a target, whereupon, the first and second shell portions 202 and 204 and the outer shell 232 of the inner paintball 230 fracture, thereby releasing the first, second and third liquids upon the target to provide a mark with an inner third color surrounded by outer first and second colors. In the event that a device was required to "stick" to a target such as an animal or moving car for tracking purposes, the device would replace the inner paintball 230 and the first and second liquids would include adhesive properties that would secure the device to the stationary or moving object after the projected outer paintball struck the object and fractured.

Referring to FIGS. 13A and 13B, to fabricate a paintball having an outer paintball about a plurality of inner paintballs 236, the inner paintball 230 of FIGS. 12A and 12B is replaced with a plurality of inner paintballs 236, each paintball 236 having an outer shell and an inner liquid with a third color. The plurality of inner paintballs 236 are disposed in the relatively viscous first and second liquids 208 and 210 in the first and second shell portions 202 and 204, such that the inner paintballs 236 are submerged in the first and second liquids 208 and 210 with the level of the first and second liquids 208 and 210 being substantially flush with corresponding annular portions 212 of the first and second shell portions 202 and 204. Before joining the first and second shell portions 202 and 204 together, the plurality of inner paintballs 236 must be disposed to provide a centralized center of gravity within the joined first and second shell portions 202 and 204, whereupon an outer paintball is fabricated about the plurality of inner paintballs 236 such that the positions of the inner paintballs 236 are substantially maintained via the first and second liquids 208 and 210 when the outer paintball is discharged from a paintball discharge device to ultimately strike a target. The first and second shell portions 202 and 204, and the outer shells of the plurality of inner paintballs 236 fracture, thereby releasing the first, second and third colored liquids upon the target to provide a relatively large first and second color mark with a plurality of relatively small third color marks distributed within the relatively large first and second color mark.

The aforementioned paintballs and variations and the methods to manufacture same in sufficient quantities with required quality can be a daunting project. Therefore, the present invention includes the equipment and methods required to fabricate large quantities of the aforementioned paintballs quickly and inexpensively.

Referring now to FIG. 14, a block diagram is depicted of a system 248 for manufacturing a plurality of the aforementioned paintballs simultaneously. The equipment required to construct a system 248 that implements a preferred method for manufacturing paintballs, and in particular, for manufacturing water based paintballs in accordance with the present invention is generally well known to those of ordinary skill in the art. The equipment includes first and second polymer sheet rolls 250 and 252 rotationally secured to a sheet thermoforming press 258, each polymer sheet roll 250 and 252 feeds a continuous polymer sheet, via first and second conveyor lines 253 and 255 that travel at the same speed. Each polymer sheet travels over a dedicated heated thermoforming plate 254 and 256 disposed within the sheet thermoforming press 258. Each heated thermoforming plate 254 and 256 is comparable to a square bottom portion of an egg carton. The polymer sheets cooperate with the thermoforming plates 254 and 256 and the sheet forming press 258 to form first and second shell sheets 257 and 259, the first and second shell sheets 257 and 258 each including a plurality of hemispherical shell portions 260 that are joined together via a polymer "web" 262, each shell portion 260 including an inner recess 206 (see FIGS. 15A-15B and 16A-16B). The system 248 further includes first and second paint dispensing units 268 and 270 for respective conveyor lines 253 and 255.

After the first conveyor line 253 places the first shell sheet 257 beneath the first paint dispensing unit 268, the first paint dispensing unit 268 fills each recess 206 of the first shell sheet 257 with a predetermined volume of a first liquid 208 or fill having gel viscosity, which includes about ninety to ninety-nine percent water. After the second conveyor line 255 places the second shell sheet 259 beneath the second fill dispensing unit 270, the second fill dispensing unit 270 fills each recess 206 of the second shell sheet 259 with a predetermined volume of a second liquid 210 or fill having gel viscosity, which includes about ninety to ninety-nine percent water. First and second adhesive applicators 272 and 274 provide an adhesive to the planar surface of respective first and second shell sheets 257 and 259. The adhesive applicators 272 and 274 may also apply an adhesive accelerant, or an annulus 224 pursuant to the requirements of the previously described paintballs. An inversion unit 276 then elevates an inverts the second shell sheet 259 such that the second shell sheet 259 is disposed above, aligned with and parallel with the first shell sheet 257, thereby axially aligning hemispheric shell portions 260 in the second shell sheet 259 with hemispheric shell portions 260 in the first shell sheet 257 (see FIG. 17). The viscous second liquid 210 or gel is sufficiently "rigid" to provide a coefficient of friction that prevents the second liquid 210 from dropping from the inverted second shell sheet 259. The inversion unit 276 ultimately joins the second shell sheet 259 to the first shell sheet 257. The second conveyor line 255 ends.

The first conveyor line 257 continues and delivers the joined second and first shell sheets 259 and 257 to a cutting unit 278 which separates the joined hemispheric shells 260 from the web 262, thereby forming paintballs or projectile capsules that fall into a hopper 280, while the removed web is discarded. The projectile capsules can be utilized for the delivery of marking fills for the sport of paintball, latex paints for marking trees or wildlife, animal attractants, crowd control marking or irritants, and pyrotechnic ingredients for forestry to name a few.

The two polymer sheet rolls 250 and 252 that ultimately form the first and second shell portions 260 are fabricated from an extrudable thermoplastic, water-insoluble, biodegradable polymer. The shell portions 260 contain a shear thinning aqueous gel fill, for carrying the deliverable ingredients. The shell portions 260 are 0.005 inches-0.020 inches thick selected from the group consisting of polyhydroxybutyrate, Ecoflex™ (BASF), Ecoflex™/PLA (Polylactic Acid) blends, Ecoflex™/Starch polymer blends, PGA (Polyglycolic Acid), PGA/PLA copolymers, and preferably PLA 2002D from Natureworks, LLC. During the extrusion process, additives such as lubricants, anti-tack agents, and anti-blocking agents may be added to polymers using methods and quantities specific to the polymer and known to those skilled in the art of extrusion. Preferred polymer mechanical properties include 2000-6000 psi tensile strength, ≦300% elongation at break, and ≧10,000 psi tensile modulus. The polymers can be extruded into rolled sheet stock of desirable dimensions, for thermoforming and part assembly, using commercially available processing equipment such as 1.5" single-screw extruder with three roll sheet system manufactured by Wayne Machine & Die Co. The extruded sheet material is further processed, by vacuum thermoforming, into the desired shape and size for the projectile needed using the commercially available thermoforming press 258 above that includes G.N. High Speed Pressureformer Model GN2220C manufactured by GN Thermoforming Equipment.

The adhesives applied by the adhesive applicators 272 and 274 are selected from the group consisting of cyanoacrylate, polyurethane adhesives, hot melt adhesives, epoxies, UV curable adhesives, and preferably ethyl cyanoacrylate such as Loctite® 454 Prism® Surface Insensitive Instant Adhesive Gel with 7452™ Accelerator Tak Pak® by Henkel Corporation. Adhesives are applied to the projectile seal area using precision applicator equipment manufactured by Henkel Corporation.

The first and second liquids 208 and 210 or gels include a rheology modifier capable of forming a highly thixotropic gel of viscosities in the range of 40,000-100,000 cps (centipoise) at 25 C and selected from the group consisting of about 1-5% Laponite, about 0.1-1.0% crosslinked carboxylic copolymer, and preferably 0.1-0.7% hydrophobically modified, crosslinked polyacrylate such as Carbopol™ EZ-3 from Noveon Corporation. A neutralizing agent consisting of an acid or base may be required in quantities, depending on the specific rheology modifier used, sufficient to adjust the pH of the projectile fill composition to 6.0-8.0 so that the fill will not be irritating to human or non-human skin or eyes on contact. The first and second liquids 208 and 210 are precisely dispensed into the recesses 206 of the shell portions 260 by the first and second paint dispensing units 268 and 270, both manufactured by EFD, Inc.

The first and second liquids 208 and 210 or gels may further include pigments and/or dye combinations, or glow phosphors, in the case of sport paintballs, in proprietary blends and quantities commonly known to those skilled in the art. Other deliverables are included in the projectile fill in quantities sufficient to complete the mass balance and appropriate to the final product specifications.

The preferred method for manufacturing paintballs, and in particular, water based paintballs in accordance with the present invention is denoted as numeral 300 and is depicted in the process flow diagram of FIG. 18.

Referring to FIG. 18, the preferred method 300 includes the steps of:

(1) compounding a commercially available, biodegradable, water-insoluble, thermoplastic, extrusion grade polymer which contains selected pigments or colors, processing aids, and property modifiers, all well known to those of ordinary skill in the art (block 302);

(2) extruding the polymer into rolled sheeting of a desired thickness generally in the range of 0.005"-0.020" (block 304);

(3) heating and vacuum thermoforming the rolled sheeting with the aid of matched metal molds, or plug assists, to form "webs" containing a matrix of paintball half shapes (block 306);

(4) mixing an aqueous based gel to act as a filler material, which includes (a) a rheology modifier, such as Laponite RD or Carbopol EZ-3 (b) pigments, dyes, phosphors, surfactants, opacifiers, drugs, nutritionals, and/or additives suitable for a specific application, (c) a neutralizing agent in quantities sufficient to neutralize at least 75% of the carboxylic acid groups on the carboxylic polymer thickeners, (d) a weak organic acid in quantities sufficient to adjust the pH of the aqueous fillers to pH 6.0-8.0 (block 308);

(5) filling the paintball halves with a precisely measured amount of the shear thinning aqueous gel, so that the fill will self-level therein and quickly become gelled, thereafter the adhesion force of the aqueous gel with the inner diameter of the outer shell, being sufficient to prevent running, flowing, or otherwise vacating to any degree the recess or cavity it now occupies (block 310);

(6) removing any excess filler from the fill recesses or cavities, by scraping the top of the webbing with a squeegee, thereby ensuring that the aqueous filler does not protrude above the top surface of the cavity or combine to exceed the total volume of the soon to be single inner chamber (block 312);

(7) after removing excess fill, the level of filler may be reduced slightly (0.001"-0.020") to below the surface level of the cavities, to allow for the introduction of an adhesive in the area of the seam radius thereby ensuring the filler does not interfere with the joining method being employed. The webbing with the now filled cavities is run through a dry air chamber, and/or exposed to a moderate heat source, or has warm/dry air blown over the cavities to allow a small amount of moisture to evaporate from the gel. This causes the gel level within the cavity to recess and provides excess volume capacity for the adhesive to be placed at the seam. This permits the adhesive to maintain its location in the seam area without being displaced by gel filler. Therefore, the adhesive remains in the gap between assembled shell halves, which occurs due to a radius at the transition point in thermoformed parts. Further this creates a stronger bond and ensures that the two halves are completely sealed together from the time the paintball is cut out or otherwise removed from the webbing, up until it impacts a target (block 314);

(8) applying an adhesive by spray, nozzle, brush or other suitable method, that is compatible with the polymer being employed as the outer shell. The adhesive is disposed in sufficient quantity upon at least one annular portion of the first and second shell portions. The annular portions are the areas that come into contact such that no outer ridges are formed. An adhesive accelerator is applied by brush, spray, nozzle, or other suitable method upon the second shell portion annular joining surface, which is meant to reduce the cure time of the adhesive resulting in a most efficient production system (block 316);

(9) manipulation and orientation of the shell halves to oppose each other such that the inner cavities which contains an aqueous fill, may be brought together to create a single inner chamber. This permits the adhesive and accelerator to come into contact with one another, and allows the adhesive to quickly cure, thereby creating a relatively strong tight seal to form the spherical paintball with a single inner chamber (block 318); and

(10) removing the now sealed paintballs from the webbing by way of hot knives or by use of a mechanical cutting system.

Now, having defined the general steps and method to manufacture a paintball of the present invention, a preferred method is hereafter more precisely defined, however it is not intended to be limiting to the other embodiments of the present invention or methods thereof which may vary according to their respective components (block 320).

Referring now to step (1) herein, the outer shell material is fabricated from a water-insoluble, extrusion grade, biodegradable, thermoplastic Polylactic Acid (PLA), preferably PLA 2002D manufactured by Natureworks, LLC. The physical properties of the PLA having a breaking strength, tensile strength and elongation at break, suitable to ensure fracturing of the outer shell subsequent to projection and striking a target. The PLA is compounded with pigments or dyes to obtain a colored paintball shell, or glow phosphors such as Copper Doped Zinc Sulfide (ZnS:Cu) manufactured by Day-glo Color Corporation of Cleveland, Ohio (Nightglo Pigment NG-20). These pigments, and/or phosphors, being compounded in a quantity sufficient to render the PLA opaque, and the quantities of each being known to those of ordinary skill in the art. However, should these glow phosphors be included in the aqueous filler, the outer PLA shell should remain transparent to facilitate maximum transmission of ultra violet light energy for excitation of the glow phosphors.

Referring now to step (2), the compounded PLA with the desired pigment and/or phosphor colors is extrusion cast into a rolled sheet using equipment and processes well known to those of ordinary skill in the art. The PLA sheet should have a thickness of approximately 0.010", and a width sufficient for the thermoforming molds being employed. The PLA sheet is then fed into a thermoforming machine, and secured to a mold, which has disposed upon it a predetermined quantity of cavities whose inner diameter will define the outer diameter of the rigid shell halves to be formed. In the case of a .68 caliber paintball this is a shell half with a 0.3425-0.345" radius.

Referring now to step (3), the rigid PLA sheet is heated to the prescribed processing temperature for the polymer grade used, and allowed to soften, so that it can be pulled into the aforementioned cavities by way of vacuum and/or plug assist methods. After being compressed into the cavities, and then immediately cooled, the PLA again assumes a rigid form, and now an array of half shell cavities exists. These cavities are the receptacles for the aqueous filler and when two halves are brought together, define a single interior chamber.

Referring now to step (5), the web of formed shell halves within the PLA are positioned beneath precision metering nozzles which inject a sufficient quantity of prepared aqueous gel fill therein. In the case of .68 caliber paintball shell halves, this is a combined weight of approximately 2.5 g-3.2 g. The application of shear stress causes the gel to liquefy, allowing the transfer from the filling system into the cavities. Immediately upon coming to rest within the shell half cavity, the gel stabilizes and generates an adhesion force with the inner surface of the outer shell wall.

Referring now to step (6), and after the stabilization of the filler, which generally takes less than a second, a squeegee is drawn across the webbing, perpendicular to the material process direction of the PLA. The squeegee removes any excess filler, and acts to ensure the gel occupies the precise volume of the cavity and does not extend above the top surface of the webbing.

Referring now to step (7), webbings of cavities are run through a dry air chamber, and/or exposed to a moderate heat source wherein the exposure time and/or temperature is directly proportionate to the amount of moisture desired to evaporate from the fill, thereby causing a slight recess of the fill within the cavity. This reduction below the surface of the webbing is in the preferred range of 0.001"-0.020". Thus each cavity has a relatively small amount of excess volume, which permits the application of adhesive at the interfacing or seam area of the shell half. This is necessary because the gap filling adhesive must occupy a small amount of the internal volume of the soon to be formed, single inner chamber. In order to create a strong bond the adhesive must fill the gap between shell halves at the seam radius between the top and bottom halves. Thus, two shell halves combined have an air gap between filler surfaces in the range of 0.002"-0.040" in height and has an inner diameter equal to that of the inner cavity of the projectile. A suitable dry air/heat chamber is that such as made by Gruenberg Industrial Conveyor Oven Model MM45H187 with horizontal air flow, −40° F. dew point, and up to 450° F. maximum temperature.

Referring now to step (8), and after the aqueous gel is leveled within the cavity, precision dispensing nozzles are employed to apply an adhesive, such as Ethyl Cyanoacrylate, to the interfacing surface of the bottom shell half webbing. Sufficient bond strength is required in order to maintain the integrity of the inner chamber and prevent exposure of the inner aqueous fill to the environment prior to the intended ejection from the capsule. Therefore, an adequate adhesive is Ethyl Cyanoacrylate or Loctite® 454 Prism® Surface Insensitive Instant Adhesive Gel made by Henkel Technologies.

The adhesive is precisely applied to form a complete ring, which begins at the inner diameter of the cavity, and extends outward. This adhesive ring is approximately 0.125" in width, and rests on the interfacing portion of the shell half. The width of the adhesive ring is greater than the width of the outer shell wall to ensure that the entire surface area, which will contact an opposing half, can be sealed with the adhesive. Concurrent to the adhesive being applied, an accelerator, which reduces the cure time of the adhesive, is applied to the opposing web of shell halves. This accelerator should be appropriate for the adhesive being applied. A suitable accelerator for use with Loctite® 454 is Loctite® 7452™ Accelerator Tak Pak® made by Henkel Technologies. The employment of the accelerator in this instance reduces the overall cure time of the adhesive from approximately 2 minutes, to 4 seconds, facilitating an expedient assembly process for efficient production.

The accelerator is applied to the entire opposing web of cavities, to ensure a consistent coating is applied and no voids are present which may compromise the curing process of the adhesive. The accelerator is applied with a precision nozzle(s) which is capable of depositing an amount sufficient to coat the top half of webbing. The evaporation of the solvent within the accelerator is necessary in order to ensure proper interaction with the adhesive. In the case of Loctite® 7452™ this is generally 4-10 seconds after it is applied.

Referring now to step (9), and after the accelerator dries, this web of cavities is rotated 180 degrees such that the cavity and aqueous filler is facing downward. No barrier or sheet of material is required to prevent the aqueous filler from flowing out of the cavity. This is because the force of gravity acting upon the fill is overcome by the adhesion force of the aqueous gel to the inner diameter of the outer shell and the flow properties of the gel. Thus, either web can be easily manipulated and oriented to perfectly align every cavity with an opposing half.

This now top half is then lowered and pressed, with optimal pressure, to the bottom half, such that the opposing cavities now constitute a continuous, single inner chamber containing two aqueous fills. As the accelerator and adhesive come into contact with each other, the adhesive cures, creating a strong bond between the top and bottom shell halves. This adhesion is created at the interfacing surface area of both halves, extending outward from the inner diameter to the outer diameter of the outer shell wall, and to the extent the adhesive as been applied.

Referring now to step (10), and now, having an assembled projectile with a single continuous, internal chamber, the two independent aqueous fills therein remain in their respective halves, having between them a small air gap with a height in the range of 0.002"-0.040", until such time as a mechanical force is applied which causes the viscosity of the fill to lower temporarily. Hereafter the capsules are ready for removal from the webbing. A precision cutting tool, with an inner diameter that matches the outer diameter of the projectile is then utilized to cut the paintballs from the excess webbing. The result is a paintball of desired size, being composed of two shell halves, now adhered together with sufficient strength such that the seal is continuous.

Alternative methods for assembly and/or creating a seal between the two shell halves include, but are not limited to:

(a) use of a heat source wherein a specific amount of heat is applied to the interfacing area of the shell halves, thereby allowing the flow of the polymer and adhesion between the two halves
(b) adhesives that cure via moisture, ultra violet light, heat, or employ two-part reactions
(c) the use of ultra sonic welding equipment to bond the two shell halves together
(d) the formation of a spherical inner aqueous gel, wherein two independent shell halves are brought together and sealed around it
(e) the formation of a spherical inner aqueous gel, that is spray coated, dip coated, or flooding of a cavity with a polymer that contains said spherical gel
(f) The use of solvent based welds or sealing methods.

Description of a Hydrophobic Barrier

A hydrophobic or water-insoluble film capable of preventing interaction between an outer water soluble shell material and an inner aqueous fill, perform as a glow-in-the-dark film coating for nighttime projectiles, and can be used with or without the glow phosphors to prevent water vapor transmission through the outer shell material from an aqueous fill, and comprised of ethyl cellulose, hydrophobic fumed silica, plasticizers, and glow phosphors. Examples of film coatings are:

1. Functional projectile film coatings for the sport of paintball, latex paints for marking trees or wildlife, animal attractants, crowd control marking or irritants, pyrotechnic ingredients for forestry comprised of:
   a. A biodegradable, water-insoluble, organic solvent soluble, film-forming polymers, to provide a film approximately 0.001"-0.010" thick, selected from a group consisting of Ethocel™ made by Dow Chemical Company, and preferably Ethocel™ Std. 100 in the amount of 5%-25% solids in solution. The film-forming polymer being dissolved in a mixture of solvents that readily evaporates upon application. This mixture preferably consisting of acetone 80% and xylenes 20%.
   b. A water repellent additive compatible with ethyl cellulose, selected from a group of hydrophobic silicone dioxides and preferably Wacker HDK H18, hydrophobic amorphous fumed silica made by Wacker Chemical Corporation, Michigan, USA in the amount of 1%-5% solids in solution.
   c. A plasticizer to increase the flexibility of the film to prevent micro-fractures from occurring, selected from a group of water-insoluble plasticizers consisting of phthalates, epoxidized vegetable or soybean oil, dibutyl sebecate, or tributyl citrate and preferably Dibutyl Sebecate, N.F. made by Vertellus Performance Materials, Inc. of Greensboro, N.C. and in the amount of 1%-3% in solution.
   d. A glow phosphor, if a glow-in-the-dark film coating is desired, selected from a group of phosphors that are insoluble or have low solubility in water, and are compatible with the organic solvents being employed, such as Copper-doped Zinc Sulfide (ZnS:Cu), coated Alkaline Aluminates, Alkaline Silicates, Strontium Aluminate, Strontium Aluminate activated by Europium (SrAlO3:Eu), Iridium or Boron Oxides and preferably NG-20™ (Copper-doped Zinc Sulfide ZNS:Cu) made by Day Glo Corporation of Cleveland Ohio in the amount of 5-10% solids in solution.

The invention claimed is:

1. A paintball comprising:

first and second shell portions;

a first liquid disposed in said first shell portion until a predetermined first liquid volume is disposed in said first shell portion, said first liquid volume being relatively smaller than a volume of a recess in said first shell portion, thereby providing an exposed inner spherical wall portion of said first shell portion that extends above said first liquid volume to an annular portion of said first shell portion;

a viscous second liquid disposed in said second shell portion until a predetermined second liquid volume is disposed in said second shell portion, said second liquid volume being relatively smaller than a volume of a recess in said second shell portion, thereby providing an exposed inner spherical wall portion of said second shell portion that extends above said second liquid volume to an annular portion of said second shell portion; and means for integrally joining said first and second shell portions, whereupon, said second shell portion is inverted and disposed upon said first shell portion such that said viscous second liquid volume and said first liquid volume occupy the same position as before said second shell portion is inverted, thereby forming an air gap without providing a barrier to seal said first liquid volume in said first shell portion and without providing a barrier to seal said viscous second liquid volume in said second shell portion to maintain the relative positions of said first liquid volume and said viscous second liquid volume when integrally joining said first and second shell portions, whereby said joining means cooperate with said air gap to provide sufficient holding force to prevent said joined first and second shell portions from separating when discharged from a paintball gun.

2. The paintball of claim 1 wherein said first liquid volume includes an initial first liquid volume substantially equal to the volume of said recess in said first shell portion, said initial first liquid volume ultimately being reduced to said first liquid volume.

3. The paintball of claim 2 wherein said initial first liquid volume is reduced to said first liquid volume via heating means that evaporate a predetermined portion of said initial first liquid volume.

4. The paintball of claim 2 wherein said integral joining means includes an annulus and means for securing said first and second shell portions to said annulus, thereby increasing the force holding said first and second shell portions together.

5. The paintball of claim 1 wherein said second liquid volume includes an initial second liquid volume substantially equal to the volume of said recess in said second shell portion, said initial second liquid volume ultimately being reduced to said second liquid volume.

6. The paintball of claim 5 wherein said initial second liquid volume is reduced to said second liquid volume via heating means that evaporate a predetermined portion of said initial second liquid volume.

7. The paintball of claim 1 wherein said first liquid volume is vibrated until leveled to a substantially planar surface.

8. The paintball of claim 1 wherein said second liquid volume is vibrated until leveled to a substantially planar surface.

9. The paintball of claim 1 wherein said integral joining means includes an adhesive disposed upon at least one of said annular portions of said first and second shell portions, said adhesive ultimately flowing into said air gap to ultimately form an adhesive bead that engages said inner spherical wall portions of said first and second shell portions between said first and second liquid volumes, thereby providing increased holding force to prevent said joined first and second shell portions from separating when discharged from a paintball gun.

10. The paintball of claim 1 wherein said air gap separates said first and second liquids substantially about between two thousandths and twenty thousandths of an inch.

11. The paintball of claim 1 wherein said integral joining means includes heating means for melting annular portions of said first and second shell portions, whereupon, said annular portions are congruently engaged and allowed to cool thereby forming a paintball.

12. The paintball of claim 1 wherein said integral joining means includes an annulus and adhesive means for securing said first and second shell portions to said annulus, thereby increasing the force holding said first and second shell portions together and providing an air gap via an aperture in said annulus.

13. The paintball of claim 1 wherein said integral joining means includes an annulus, adhesive means, an adhesive bead and an air gap for increasing the force holding said first and second shell portions together.

14. The paintball of claim 1 wherein said integral joining means includes an adhesive accelerant disposed upon said annular portions of the first and second shell portions, and also upon surface portions of the first and second liquids in said recesses said first and second shell portions, said first and second liquids having volumes substantially equal to the volumes of said recesses, said adhesive accelerant forming a film having an outer radial dimension substantially equal to the outer radial dimension of said annular portions of said first and second shell portions, said film having an inner radial dimension relatively smaller than the inner radial dimension of said annular portions; whereupon, said adhesive is disposed upon said adhesive accelerant on said annular portions only, said second shell portion then being placed upon said first shell portion causing said adhesive to be squeezed from said joined shell portions and onto said adhesive accelerant inside said recesses of said joined first and second shell portions, said accelerant causing said adhesive to cure, thereby joining annular portions of said first and second shell portions, and causing said squeezed adhesive to fill-in voids caused by diverging sloping inner edges of said annular portions, said squeezed adhesive ultimately engaging portions of said inner spherical walls of said first and second shell portions adjacent to said annular portions, thereby increasing the binding force holding said first and second shell portions together.

15. The paintball of claim 1 wherein said first shell portion includes a luminescent material.

16. The paintball of claim 1 wherein said first shell portion includes an inner spherical wall having a luminescent material coated thereupon.

17. The paintball of claim 1 wherein said first shell portion includes an outer spherical wall having a luminescent material coated thereupon.

18. The paintball of claim 1 wherein said first shell portion is fabricated from PLA.

19. The paintball of claim 1 wherein said first shell portion is fabricated from polystyrene.

20. The paintball of claim 1 wherein said first shell portion is fabricated from a material different then the material of said second shell portion.

21. The paintball of claim 1 wherein said first shell portion is fabricated from a water soluble material with a water insoluble barrier coating said inner spherical wall of said first shell portion when said first liquid includes water.

22. The paintball of claim 1 wherein said second shell portion includes a luminescent material.

23. The paintball of claim 1 wherein said second shell portion includes an inner spherical wall having a luminescent material coated thereupon.

24. The paintball of claim 1 wherein said second shell portion includes an outer spherical wall having a luminescent material coated thereupon.

25. The paintball of claim 1 wherein said second shell portion is fabricated from PLA.

26. The paintball of claim 1 wherein said second shell portion is fabricated from polystyrene.

27. The paintball of claim 1 wherein said second shell portion is fabricated from a material different then the material of said first shell portion.

28. The paintball of claim 1 wherein said second shell portion is fabricated from a water soluble material with a water insoluble barrier coating said inner spherical wall of said second shell portion when said second liquid includes water.

29. The paintball of claim 1 wherein said first liquid includes a luminescent material.

30. The paintball of claim 29 wherein said second liquid includes a photoprotein to provide multiple luminescent colors.

31. The paintball of claim 1 wherein said first liquid includes a photoprotein.

32. The paintball of claim 31 wherein said second liquid includes a luminescent material to provide multiple luminescent colors.

33. The paintball of claim 1 wherein said first liquid includes a color different than the color of said second liquid.

34. The paintball of claim 1 wherein said first liquid includes a viscous liquid.

35. The paintball of claim 1 wherein said first liquid includes a plurality of viscous first liquids each having a different color to form varying configurations.

36. The paintball of claim 1 wherein said first liquid includes an evaporating liquid for promoting an air gap for joining said first and second shell portions, and for reducing cleanup time.

37. The paintball of claim 1 wherein said first liquid includes an aqueous liquid.

38. The paintball of claim 1 wherein said first liquid includes a shear thinning agent that provides a relatively low viscosity first liquid when said first liquid is forcibly disposed in said first shell portion, whereupon, said first liquid changes state at rest to a relatively high viscosity gel that maintains a constant position within said first shell portion, irrespective of the orientation of said first shell portion, to ultimately form said air gap that promotes the joining together of said first and second shell portions; and providing a relatively low viscosity first liquid when said paintball forcibly strikes a target, thereby allowing said first liquid to flow upon and mark the target, said first liquid ultimately returning to said gel state while disposed upon the target.

39. The paintball of claim 38 wherein said shear thinning agent includes a thixotropic agent.

40. The paintball of claim 39 wherein said thixotropic agent includes a rheology modifier.

41. The paintball of claim 38 wherein said shear thinning agent promotes multiple colored gels in said first shell portion.

42. The paintball of claim 41 wherein said multiple colored gels form varying predetermined configurations.

43. The paintball of claim 1 wherein said second liquid includes a shear thinning agent that provides a relatively low viscosity second liquid when said second liquid is forcibly disposed in said second shell portion, whereupon, said second liquid changes state at rest to a relatively high viscosity gel that maintains a constant position within said second shell portion, irrespective of the orientation of said second shell portion, to ultimately form said air gap that promotes the joining together of said first and second shell portions; and providing a relatively low viscosity second liquid when said paintball forcibly strikes a target, thereby allowing said second liquid to flow upon and mark the target, said first liquid ultimately returning to said gel state while disposed upon the target.

44. The paintball of claim 43 wherein said shear thinning agent includes a thixotropic agent.

45. The paintball of claim 44 wherein said thixotropic agent includes a rheology modifier.

46. The paintball of claim 43 wherein said shear thinning agent promotes multiple colored gels in said second shell portion.

47. The paintball of claim 46 wherein said multiple colored gels form varying predetermined configurations.

48. The paintball of claim 1 wherein said second liquid includes a luminescent material.

49. The paintball of claim 1 wherein said second liquid includes a photoprotein.

50. The paintball of claim 1 wherein said viscous second liquid includes a color different than the color of said first liquid.

51. The paintball of claim 1 wherein said second liquid includes a non-viscous liquid.

52. The paintball of claim 1 wherein said second liquid includes a plurality of viscous liquids each having a different color to form varying configurations.

53. The paintball of claim 1 wherein said second liquid includes an evaporating liquid for promoting an air gap for joining said first and second shell portions, and for reducing cleanup time.

54. The paintball of claim 1 wherein said second liquid includes an aqueous liquid.

55. The paintball of claim 1 wherein said joined first and second shell portions include an inner paintball centrally disposed.

56. The paintball of claim 1 wherein said joined first and second shell portions include a plurality of inner paintballs.

57. The paintball of claim 1 wherein said first and second shell portions include an outer coating for increasing the bonding of joined first and second shell portions.

58. The paintball of claim 57 wherein said outer coating includes means for preventing the evaporation of said first and second liquids from said first and second shell portions.

59. The paintball of claim 1 wherein said first and second liquids include an inert substance for increasing the density of said first and second liquids.

60. An aqueous paintball comprising:

first and second shell portions;

an aqueous first liquid disposed in said first shell portion until a predetermined first liquid volume is disposed in said first shell portion, said first liquid volume being relatively smaller than a recess volume in said first shell portion, thereby providing an exposed inner spherical wall portion of said first shell portion that extends above said first liquid volume to an annular portion of said first shell portion;

an aqueous viscous second liquid disposed in said second shell portion until a predetermined second liquid volume is disposed in said second shell portion, said second liquid volume being relatively smaller than a recess volume in said second shell portion, thereby providing an exposed inner spherical wall portion of said second shell portion that extends above said second liquid volume to an annular portion of said second shell portion; and adhesive means for integrally joining said first and second shell portions, whereupon, said second shell portion is inverted and disposed upon said first shell portion such that said viscous second liquid volume and said first liquid volume occupy the same relative positions as before said second shell portion is inverted thereby forming an air gap without providing a barrier to seal said first liquid volume in said first shell portion and without providing a barrier to seal said viscous second liquid volume in said second shell portion to maintain the relative positions of said first liquid volume and said viscous second liquid volume when integrally joining said first and second shell portions, whereby said adhesive flows into said air gap to ultimately form an adhesive bead that engages said inner spherical wall portions of said first and second shell portions between said first and second liquid volumes, thereby providing increased holding force to prevent said joined first and second shell portions from separating when discharged from a paintball gun.

61. An aqueous paintball having an annulus therein for increased binding force comprising:

first and second shell portions;

an aqueous first liquid disposed in said first shell portion until a predetermined first liquid volume is disposed in said first shell portion, said first liquid volume being relatively smaller than a recess volume in said first shell portion, thereby providing an exposed inner spherical wall portion of said first shell portion that extends above said first liquid volume to an annular portion of said first shell portion;

an aqueous viscous second liquid disposed in said second shell portion until a predetermined second liquid volume is disposed in said second shell portion, said second liquid volume being relatively smaller than a recess volume in said second shell portion, thereby providing an exposed inner spherical wall portion of said second shell portion that extends above said second liquid volume to an annular portion of said second shell portion; and an annulus disposed between annular portions of said first and second shell portions, said annulus being secured to said annular portions via joining means, thereby increasing the force holding said first and second shell portions together and providing an air gap via an aperture in said annulus without providing a barrier to seal said first liquid volume in said first shell portion and without providing a barrier to seal said viscous second liquid volume in said second shell portion to maintain the relative positions of said first liquid volume and said viscous second liquid volume when joining said first and second shell portions.

62. The aqueous paintball of claim 61 wherein said joining means includes an adhesive, said aperture in said annulus providing an air gap for excess adhesive to accumulate to prevent said excess adhesive from degrading said aqueous first and second liquids.

63. The aqueous paintball of claim 61 wherein said joining means includes means for heating said annular portions of said first and second shell portions, said annular portions ultimately melting and becoming integrally joined when cooled.

64. An aqueous paintball comprising:

first and second shell portions;

an aqueous first liquid disposed in said first shell portion until a predetermined first liquid volume is disposed in said first shell portion, said first liquid volume being relatively smaller than a recess volume in said first shell portion, thereby providing an exposed inner spherical wall portion of said first shell portion that extends above said first liquid volume to an annular portion of said first shell portion;

an aqueous viscous second liquid disposed in said second shell portion until a predetermined second liquid volume is disposed in said second shell portion, said second liquid volume being relatively smaller than a recess volume in said second shell portion, thereby providing an exposed inner spherical wall portion of said second shell portion that extends above said second liquid volume to an annular portion of said second shell portion, said first and second liquids cooperating to form an air gap without providing a barrier to seal said first liquid in said first shell portion and without providing a barrier to seal said viscous second liquid in said second shell portion to maintain the relative positions of said first liquid volume and said viscous second liquid volume when joining said first and second shell portions; and an accelerant coating upon annular portions of said first and second shell portions, said accelerant ultimately receiving an adhesive thereupon, said accelerant and said adhesive cooperating to quickly bind together said annular portions of said first and second shell portions thereby increasing the binding force holding said first and second shell portions together.

65. An aqueous paintball device comprising:

first and second shell portions;

an aqueous first liquid disposed in said first shell portion until a predetermined first liquid volume is disposed in said first shell portion, said first liquid volume being relatively smaller than a recess volume in said first shell portion, thereby providing an exposed inner spherical wall portion of said first shell portion that extends above said first liquid volume to an annular portion of said first shell portion;

an aqueous viscous second liquid disposed in said second shell portion until a predetermined second liquid volume is disposed in said second shell portion, said second liquid volume being relatively smaller than a recess volume in said second shell portion, thereby providing an exposed inner spherical wall portion of said second shell portion that extends above said second liquid volume to an annular portion of said second shell portion; and means for melting said annular portions of said first and second shell portions, whereupon, said second shell portion is inverted and disposed upon said first shell portion such that said viscous second liquid volume and said first liquid volume occupy the same respective positions as before said second shell portion is inverted thereby forming an air gap without providing a barrier to seal said first liquid in said first shell portion and without providing a barrier to seal said viscous second liquid in said second shell portion to maintain the relative positions of said first liquid and said viscous second liquid when joining said first and second shell portions, whereby said first and second shell portions are secured together via said melted annular portions, thereby providing increased holding force to prevent said joined first and second shell portions from separating when discharged from a paintball gun.

66. A paintball comprising:

first and second shell portions;

a first liquid disposed in said first shell portion until a predetermined first liquid volume is disposed in said first shell portion, said first liquid volume being relatively smaller than a recess volume in said first shell portion, thereby providing an exposed inner spherical wall portion of said first shell portion that extends above said first liquid volume to an annular portion of said first shell portion;

a second liquid disposed in said second shell portion until a predetermined second liquid volume is disposed in said second shell portion, said second liquid volume being relatively smaller than a recess volume in said second shell portion, thereby providing an exposed inner spherical wall portion of said second shell portion that extends above said second liquid volume to an annular portion of said second shell portion, said second liquid including a shear thinning agent that provides a relatively low viscosity second liquid when said second liquid is forcibly disposed in said second shell portion, whereupon, said second liquid changes state at rest to a relatively high viscosity gel that maintains a constant position within said second shell portion, irrespective of the orientation of said second shell portion, to ultimately form an air gap that promotes the joining together of said first and second shell portions; and providing a relatively low viscosity second liquid when said paintball forcibly strikes a target, thereby allowing said second liquid to flow upon and mark the target, said second liquid ultimately returning to said gel state while disposed upon the target;

means for integrally joining said first and second shell portions, whereupon, said second shell portion is inverted and disposed upon said first shell portion such that said viscous second liquid volume and said first liquid volume occupy the same relative positions as before said second shell portion is inverted, thereby forming an air gap without providing a barrier to seal said first liquid volume in said first shell portion and without providing a barrier to seal said second liquid volume in said second shell portion to maintain the relative positions of said first liquid volume and said second liquid volume when joining said first and second shell portions, whereby said adhesive flows into said air gap to ultimately form an adhesive bead that engages said inner spherical wall portions of said first and second shell portions between said first and second liquid volumes, thereby providing increased holding force to prevent said joined first and second shell portions from separating when discharged from a paintball gun.

67. A paintball comprising:

first and second shell portions;

an initial first liquid volume disposed in said first shell portion, said first liquid volume being substantially equal to a recess volume in said first shell portion, said initial first liquid volume ultimately being reduced to a first liquid volume relatively smaller than said recess volume in said first shell portion, thereby providing an exposed inner spherical wall portion of said first shell portion that extends above said first liquid volume to an annular portion of said first shell portion;

an initial viscous second liquid disposed in said second shell portion, said viscous second liquid volume being substantially equal to a recess volume in said second shell portion, said initial viscous second liquid volume ultimately being reduced to a viscous second liquid volume relatively smaller than said recess volume in said second shell portion, thereby providing an exposed inner spherical wall portion of said second shell portion that extends above said viscous second liquid volume to an annular portion of said second shell portion; and means for integrally joining said first and second shell portions, whereupon, said second shell portion is inverted and disposed upon said first shell portion such that said viscous second liquid volume and said first liquid volume occupy the same relative positions as before said second shell portion is inverted, thereby forming an air gap without providing a barrier to seal said first liquid volume in said first shell portion and without providing a barrier to seal said viscous second liquid volume in said second shell portion to maintain the relative positions of said first liquid volume and said viscous second liquid volume when joining said first and second shell portions, whereby said air gap and said joining means cooperate to provide increased holding force to prevent said joined first and second shell portions from separating when discharged from a paintball gun.

68. The paintball of claim 67 wherein said integrally joining means includes an adhesive that flows into said air gap to ultimately form an adhesive bead that engages said inner spherical wall portions of said first and second shell portions between said first and second liquid volumes, thereby providing increased holding force to prevent said joined first and second shell portions from separating when discharged from a paintball gun.

69. The paintball of claim 67 wherein said integrally joining means includes means for heating said annular portions of said first and second shell portions, said annular portions ultimately melting and becoming integrally joined when cooled.

* * * * *